US006983874B2

(12) United States Patent
Bakx

(10) Patent No.: US 6,983,874 B2
(45) Date of Patent: Jan. 10, 2006

(54) ARTICLE CARRIER AND BLANK THEREFOR

(75) Inventor: Martinus C. M. Bakx, Goes (NL)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 412 days.

(21) Appl. No.: 10/217,503

(22) Filed: Aug. 13, 2002

(65) Prior Publication Data

US 2002/0179459 A1 Dec. 5, 2002

Related U.S. Application Data

(62) Division of application No. 09/948,251, filed on Sep. 5, 2001, now Pat. No. 6,732,857, which is a continuation of application No. PCT/US00/05804, filed on Mar. 6, 2000.

(51) Int. Cl.
*B65D 5/46* (2006.01)
*B65D 75/00* (2006.01)

(52) U.S. Cl. ..... 229/117.14; 206/176; 206/178; 206/190; 229/120.38

(58) Field of Classification Search ..... 206/167, 206/170, 174, 175, 176, 178, 180, 185, 188, 206/193, 197, 198, 190, 427; 229/120.27, 229/120.38, 117.14
See application file for complete search history.

(56) References Cited

U.S. PATENT DOCUMENTS

| | | | | |
|---|---|---|---|---|
| 2,887,246 A | * | 5/1959 | Levkoff | 206/180 |
| 2,991,908 A | * | 7/1961 | Conescu | 206/180 |
| 3,115,273 A | | 12/1963 | Gish | |
| 3,266,663 A | | 8/1966 | Ringler | |
| 3,570,706 A | | 3/1971 | Harrelsen | |
| 3,850,292 A | * | 11/1974 | Manizza et al. | 206/180 |
| 3,860,113 A | | 1/1975 | Helms | |
| 3,893,565 A | | 7/1975 | Rossi et al. | |
| 4,205,748 A | | 6/1980 | Wilson | |
| 4,243,138 A | | 1/1981 | Wilson | |
| 4,469,222 A | | 9/1984 | Graser | |
| 4,782,944 A | * | 11/1988 | Engdahl, Jr. | 206/185 |
| 5,680,930 A | | 10/1997 | Stone | |
| 6,168,013 B1 | * | 1/2001 | Gomes | 206/180 |
| 6,189,687 B1 | * | 2/2001 | Bakx | 206/175 |

FOREIGN PATENT DOCUMENTS

| | | |
|---|---|---|
| CA | 1 142 896 | 3/1983 |
| CH | 670 432 A5 | 6/1989 |
| EP | 0 894 733 A1 | 2/1999 |
| EP | 0 931 003 B1 | 7/1999 |
| GB | 1185711 | 3/1970 |
| WO | WO 98/28200 A1 | 7/1998 |

* cited by examiner

*Primary Examiner*—Luan K. Bui
(74) *Attorney, Agent, or Firm*—Tsugihiko Suzuki; Michael V. Drew; Thomas A. Boshinski

(57) ABSTRACT

An article carrier and a blank for forming an article carrier of the basket type comprising in sequence a first end panel, a first side panel, a second end panel, a second side panel and a third end panel foldably connected together one to next. A base panel is hinged to respective one of the side panels and a handle structure comprising first and second handle panels is foldably connected to the second end panel. The first handle panel is foldably connected to the first end panel and the second hand panel is foldably connected to the third end panel. The first and second handle panels are adjacent to the first and second side panels respectively and are separated therefrom. The first and second handle panels are so constructed and arranged to be placed in face contacting relationship to form a two ply handle when the carrier is set up.

13 Claims, 26 Drawing Sheets

ARTICLE CARRIER AND BLANK THEREFOR

CROSS-REFERENCE TO RELATED APPLICATIONS

This is a division of U.S. application Ser. No. 09/948,251 filed Sep. 5, 2001, now U.S. Pat. No. 6,732,857, which in turn is a continuation of international application No. PCT/US00/05804, filed 6 Mar. 2000. The international application claims priority based upon United Kingdom patent applications serial numbers 9905057.7, filed Mar. 5, 1999, and 9930490.9, filed Dec. 23, 1999.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

This invention relates to an article carrier of the basket type adapted to accommodate a plurality of articles, such as bottles and to a blank for forming the carrier. Normally a basket carrier for bottles includes a central (medial) partition structure which incorporates a handle structure by which the carrier can be lifted and carried and the bottles are arranged in rows on either side of the partition structure. More often than not, bottles are separated from one another by transverse partition panels extending from each side of the medial partition structure to the adjacent side wall of the carrier. Hence, in this type of arrangement the bottles are accommodated in individual cells of the carrier although such cells are not essential.

Known basket carriers require a series of complex folds to form partition structures, which may require the blank to be rotated or inverted during construction, thus slowing the process down.

One example of a basket style carrier is illustrated in U.S. Pat. No. 3,570,706 which discloses a carrier having side and end walls, a bottle partition structure and bottom wall with sloping panel portions provided with bottle apertures. The bottle apertures have overlying tabs to protect part of the bottle in the cut out.

Another example is illustrated in CH 670 432 which illustrates a carrier blank having side and end walls, a medial partition structure connected to the side wall by an internal partition and to the opposing end walls.

The complex structure of known basket carriers requires a large amount of board to be used with an irregular shape of blank profile, thereby resulting in material wastage, which is undesirable.

BRIEF SUMMARY OF THE INVENTION

The present invention and its preferred embodiments seek to overcome or at least mitigate the problems of the prior art. A carton of the present invention can be formed in a straight line gluing machine. It is envisaged that the invention can be used in an adapted wraparound machine, thus removing the need for dedicated machinery. One aspect of the invention provides a blank for forming an internal partition structure for an article carrier of the basket type including opposed end and side wall panels and a handle structure. The blank comprises a first medial panel adapted to be connected to the handle structure and to at least one end wall of the basket type carrier and transverse partition panels struck from the medial panel and hingedly connected thereto to create a plurality of article receiving cells on one side of the handle structure when the carrier is formed from the blank.

According to an optional feature of the first aspect of the invention there may comprise a second medial panel hingedly connected to the first medial panel, which second medial panel is adapted to be connected to the handle structure and to at least one end wall of the basket type carrier and transverse partition panels struck from the medial panel and hingedly connected thereto to create a plurality of article receiving cells on one side of the handle structure when the carrier is formed from the blank. Preferably, the medial panels may be hingedly connected along a fold line arranged substantially parallel to fold lines which hingedly interconnect the transverse partition panel to the medial panel(s). Optionally, a flap may be struck from one of the medial panels, and is hingedly interconnected to the medial panel along the medial panel fold line.

According to another optional feature of this aspect of the invention the medial panels may be hingedly interconnected along a fold line arranged substantially perpendicular to fold lines which hingedly interconnect the transverse partition panel to the medial panel(s).

According to another optional feature of this aspect of the invention each medial panel may further comprise a securing panel, each securing panel is so constructed and arranged to be secured together in a set up article carrier.

A second aspect of the invention provides a blank for forming an internal partition structure wherein the transverse partition panel is pivotally connected to a medial panel by a pair of spaced fold lines intermediate the opposing ends of the transverse partition panel thereby to create a panel which extends outwardly from both sides of the medial panel when the internal partition structure is formed in a set up carrier.

According to an optional feature of the second aspect of the invention two transverse partition panels may be struck from the blank, and are hingedly interconnected at their end remote from the medial panel once erected by a side wall securing panel.

According to another optional feature of this aspect of the invention there may further comprise a handle support panel extending from an upper portion of the medial partition panel which handle panel includes a hand aperture to be aligned with the handle structure of the article carrier.

A third aspect of the invention provides a blank for forming an article carrier of the basket type comprising a first end panel, a first side panel, a second end panel and a second side panel and a third end panel hingedly connected one to the next in series, a base panel hinged to one of the side or end panels and a handle structure including a hand aperture, which handle structure comprises first and second handle panels hingedly connected to the second end panel, the first handle panel is hingedly connected to the first end panel and the second hand panel is hingedly connected to the third end panel. The first and second handle panels are so constructed and arranged to be placed in face contacting relationship to form a two ply handle when the carrier is in a set up condition. The first and second handle panels are adjacent respective first and second side panels and are separated therefrom.

According to an optional feature of the third aspect of the invention, there may further comprise a handle support panel foldably connected to the first handle panel for forming a triple ply handle in a set up condition. Preferably, there may further comprise a second handle support panel foldably connected to the second handle panel.

According to an optional feature of the third aspect of the invention the first and second handle panels may be co-planar and the upper edges of the handle panels are co-linear.

Optionally, the upper edges of the or each handle support panel may be co-linear with the handle panels.

According to another optional feature of the third aspect of the invention the handle panels may be shaped to marry with first and second handle panels of a next adjacent blank. Preferably, the handle panels may be substantially trapezoidal in shape.

According to a further optional feature of the third aspect of the invention there may further comprise a panel arranged so as to support at least one medial panel when the blank is erected to form a carton. Preferably, a further medial support panel may be hingedly interconnected to the opposing end of the series of panels, the support panels being so arranged as to be secured to one or more faces of the medial panel(s).

According to a still further optional feature of the third aspect of the invention at least one of the support panels may be provided with a hook portion, the hook being so arranged as to engage the base panel, when the blank is erected to form a carton.

A fourth aspect of the invention provides an article carrier of the basket type having opposed sides and end panels, a base panel hinged to one or more of the side or end panels and a handle structure hingedly connected to the opposing end panels. There further comprises an internal partition structure formed from a separate blank which internal partition structure comprises a first medial panel adapted to be connected to the handle structure and to at least one end wall of the basket type carrier and transverse partition panels struck from the medial panel and hingedly connected thereto to create a plurality of article receiving cells on one side of the handle structure.

Preferably, there may comprise a second medial panel hingedly connected to the first medial panel, which second medial panel is adapted to be connected to the handle structure and to at least one end wall of the basket type carrier and transverse partition panels struck from the medial panel and hingedly connected thereto to create a plurality of article receiving cells on one side of the handle structure.

Optionally, the medial panels may be hingedly connected along a fold line arranged substantially parallel to fold lines which hingedly interconnect the transverse partition panel to the medial panel(s).

Preferably, a flap may be struck from one of the medial panels, and is hingedly interconnected to the medial panels along the medial panel fold line.

According to an optional feature of the fourth aspect of the invention the medial panels may be hingedly interconnected along a fold line arranged substantially perpendicular to fold lines which hingedly interconnect the transverse partition panel to the medial panel(s).

According to another optional feature of the fourth aspect of the invention each medial panel may further comprise a securing panel, each securing panel is so constructed and arranged to be secured together.

According to another optional feature of the fourth aspect of the invention the transverse partition panel may be pivotally connected to a medial panel by a pair of spaced fold lines intermediate the opposing ends of the transverse partition panel thereby to create a panel which extends outwardly from both sides of the medial panel.

According to another optional feature of the fourth aspect of the invention two transverse partition panels may be struck from the blank, and are hingedly interconnected at their end remote from the medial panel once erected by a side wall securing panel.

According to another optional feature of the fourth aspect of the invention there may further comprise a handle support panel extending from an upper portion of the medial partition panel which handle panel includes a hand aperture to be aligned with the handle structure of the article carrier.

In one embodiment, there may further comprise a handle support panel foldably connected to the first handle panel for forming a triple ply handle.

Alternatively, there may further comprise a second handle support panel foldably connected to the second handle panel.

According to another optional feature of this aspect of the invention the first and second handle panels may be co-planar and the upper edges of the handle panels are co-linear.

According to a further optional feature of this aspect of the invention the upper edges of the or each handle support panel may be co-linear with the handle panels.

According to still further another optional feature of this aspect of the invention the handle panels may be substantially trapezoidal in shape.

According to yet another optional feature of this aspect of the invention at least one of the support panels may be provided with a hook portion, the hook being so arranged as to engage the base panel.

A fifth aspect of the invention provides a method of forming an article carrier of the basket type from a first blank comprising a first end panel, a first side panel, a second end panel, a second side panel and third end panel hingedly connected one to the next in series, a handle structure hingedly connected to one or more of the end panels and a second blank for forming an internal partition structure. The method comprises the steps of:

- placing the second blank on the first blank in an aligned position;
- securing the transverse partition panels to the first side wall panel;
- securing the medial panel to the handle panel of the first blank;
- folding the second side wall panel and second end wall panel into face contacting relationship with the internal partition structure; and
- securing the first and the third end panels together to form a completed collapsed article carrier.

BRIEF DESCRIPTION OF THE SEVERAL VIEWS OF THE DRAWINGS

Exemplary embodiments of the invention will now be described, by way of example only, with reference to the accompanying drawings, in which.

DETAILED DESCRIPTION OF THE INVENTION

Figures 1A, 1B:
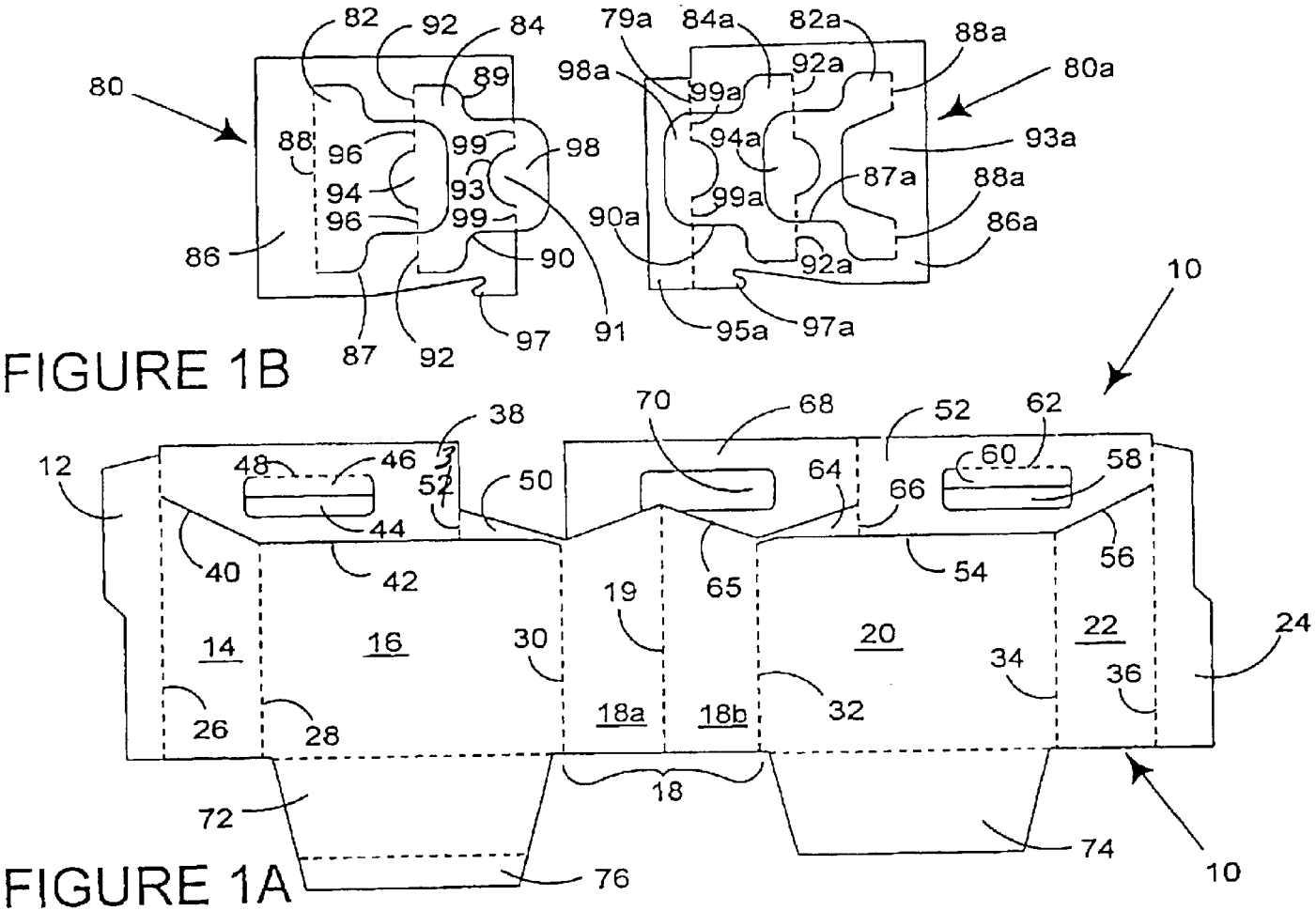
FIGS. 1A and 1B are plan views of blanks of paperboard from which an article carrier according to one embodiment of the invention is formed.

Referring to the drawings an article carrier is formed from one or more blanks of paperboard, corrugated board or other suitable foldable sheet material, for example plastics material. The carrier is adapted to accommodate a plurality of articles, for example six bottles arranged in two rows of three bottles each. It is envisaged the carrier can be adapted to accommodate a different number of bottles according to user requirements.

Turning to the first embodiment shown in FIGS. 1A and 1B there is shown a carrier formed from a three part blank. The blank 10 for forming the outer panels, includes in longitudinal series a first medial support panel 12, first end panel 14, first side panel 16, second end panel 18, second side panel 20, third end panel 22 and second medial panel 24 hingedly connected one to the next along lateral fold lines 26, 28, 30, 32, 34 and 36 respectively. There may further comprise a lateral fold line 19 intermediate fold lines 30 and 32 for dividing second end panel 18 into two parts 18*a*, 18*b* to form an "arrow profile" basket carrier, hereinafter described.

A first handle panel 38 is disposed adjacent first end panel 14 and first side panel 16 and is separated from these side and end panels by cut lines 40, 42. Cut lines 40, 42 extend between fold lines 26 and 30. Handle panel 38 is hingedly connected to first medial support panel 12 along an extension of fold line 26 which forms part of one side edge of first handle panel 38. It will be apparent to the reader that medial support panels are not an essential feature and the handle panels could be connected directly to the end panel in some embodiments. Handle panel 38 is connected to the opposing end panel 18 by means of an intermediate panel 50 which is hingedly connected to the side edge of handle panel 38 along fold line 52, and to end panel by a nick portion along fold line 30, as shown in FIG. 1A.

Handle panel 38 may include a hand aperture 44. In this embodiment, a hand cushioning flap 46 is connected along fold line 48 to an upper edge of hand aperture 44.

Preferably, a second handle panel 52 is provided which is disposed adjacent second side panel 20 and third end panel 22 and is separated from these side and end panels by cut lines 54, 56. Cut lines 54, 56 extend between fold lines 32 and 36. Handle panel 52 is hingedly connected to second medial support panel 24 along an extension of fold line 36 which forms part of one side edge of second handle panel 52. Handle panel 52 is connected to the opposing end panel 18 by means of an intermediate panel 64 which is hingedly connected to the side edge of handle panel 52 along fold line 66, and to end panel 18 by a nick portion along fold line 32, as shown in FIG. 1A.

Handle panel 52 may include a hand aperture 58. In this embodiment, a hand cushioning flap 60 is connected along fold line 62 to an upper edge of hand aperture 60.

In this embodiment, a triple ply handle structure is provided. Handle support panel 68 is disposed adjacent part of first end panel 18 and the intermediate panel 64. Handle support panel 68 is hingedly connected to a side edge of second handle panel 52 along fold line 66, but is otherwise separated from the blank by cut line 65. A hand aperture 70 is provided positioned intermediate upper and lower edges of handle support panel 68. Preferably, hand aperture 70 is positioned to be aligned with the hand apertures 44 and 58 in a set up carton.

There further comprises a base structure which in this embodiment is provided by base panels 72, 74 foldably connected to side panels 16, 20 respectively. Suitable securing means is provided for securing the base panels together. For example, a glue flap 76 is connected to the base panel 72. Alternatively, locking tabs struck from base panel and a complementary locking aperture is struck from second base panel to receive and retain the locking tabs, as is well known. It will be understood by those skilled in the art that other methods of interlocking the base panels together during construction can be adopted and the invention is not limited to those features illustrated in the embodiments or described above.

In FIGS. 1B, there is shown the partition structure of the article carrier formed from a second blank 80 and third blank 80*a*.

The blank 80 forms one side of the partition structure and comprises a pair of transverse partition panels 82, 84 struck from a medial partition panel 86. Transverse partition panel 82 is struck from medial panel 86 by cut line 87 and is connected thereto along fold line 88. Likewise, transverse partition panel 84 is struck from medial panel 86 by cut lines 89, 90 and is connected thereto along fold line 92. In this embodiment fold line 92 is interrupted by cut line 87 which extends into transverse partition panel 84 to define a glue flap 94 foldably connected to transverse partition panel 82 along fold line 96. A second glue flap 98 may be connected to transverse partition panel 84 along fold line 99. Optionally, the glue flaps 94, 98 include protruding elements 91 defined by cut line 93 which interrupts the glue flap fold line. In use, the protruding elements increase the surface area of the glue flap to be secured. A hook 97 may be provided along a lower edge of medial panel 86 to provide a detachable connection to the base structure.

The blank 80*a* is similar to blank 80 and therefore like panels are designated by the same reference numeral with addition of letter "a". Therefore, only the differences between blank 80 and blank 80*a* are described in more detail. An end flap 95*a* may be provided which is foldably connected to medial panel 86*a* along fold line 79*a*. In use, end flap 95*a* is secured to end panel 18. In use, tab 93*a* is adapted to be secured to medial support panel 12, 24 described below.

It is envisaged that the number and position of the transverse partition panels of each blank can be changed according to the number of article receiving cells required.

Figure 2A:
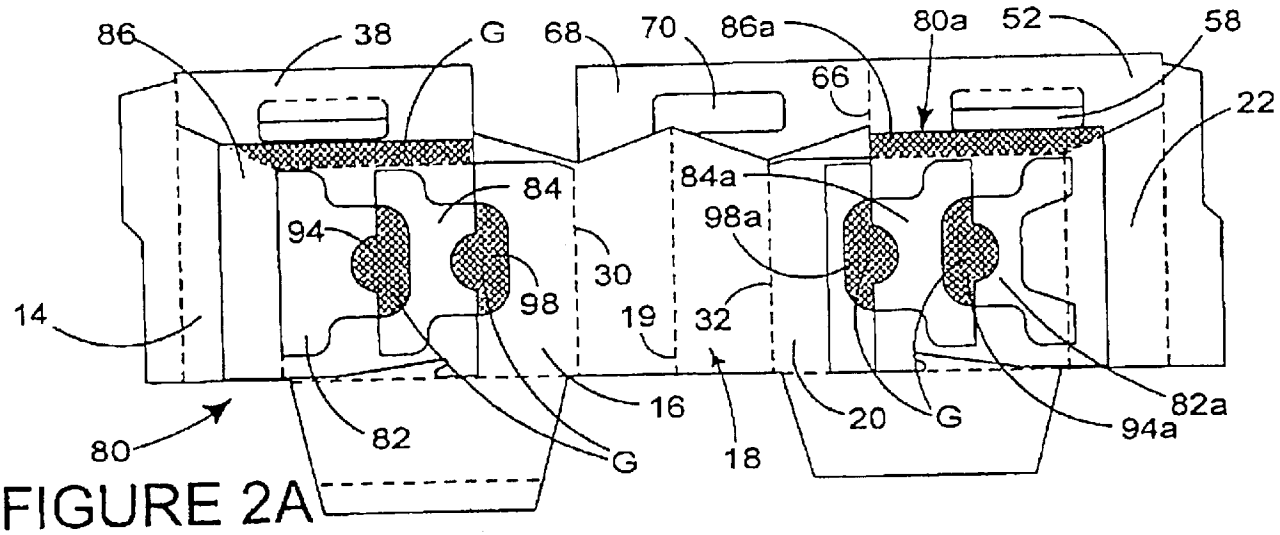
FIGS. 2A and 2B are side elevation views of the blanks shown in FIGS. 1A and 1B during construction to form a flat collapsed carton.
Figure 2B:
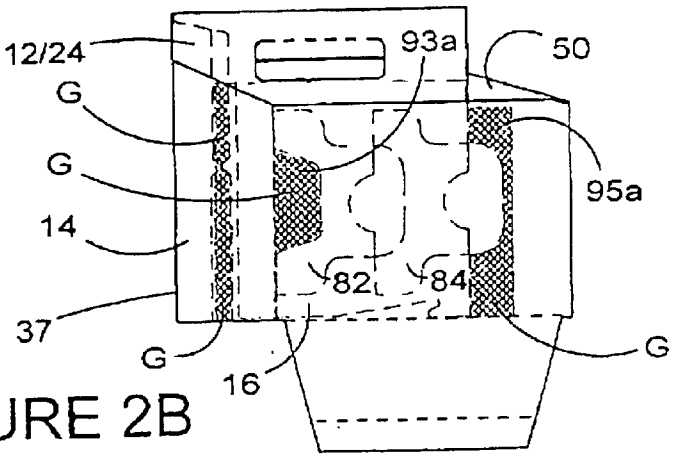
Figure 3:
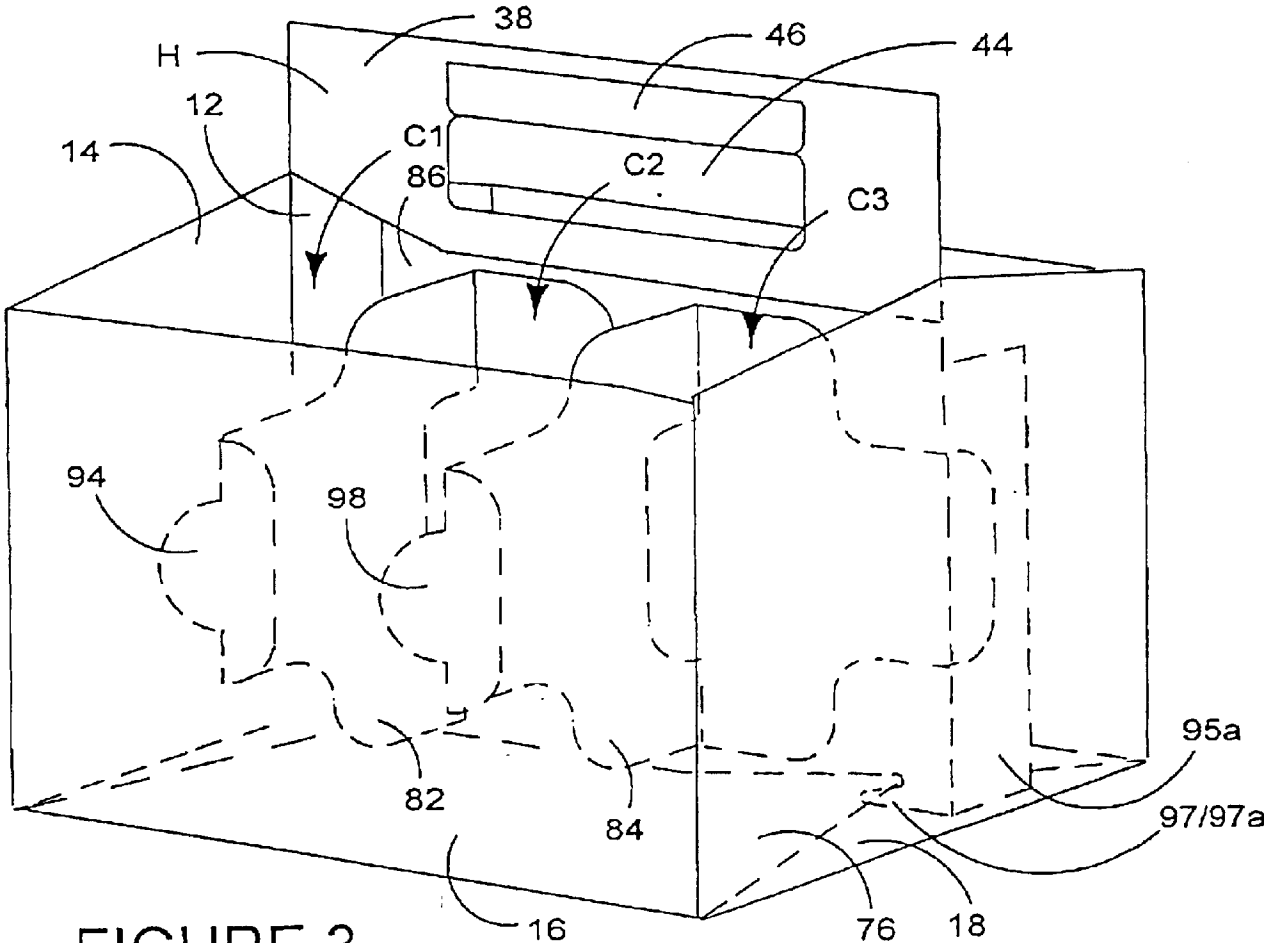
FIG. 3 is a perspective view of an erected basket carrier formed from the blank shown in FIG. 1 viewed from above and from one end.

The construction of a completed carrier of the first embodiment shown in FIGS. 2 and 3 in a flat collapsed condition from the blank requires a series of sequential folding and gluing operations which can be performed in a straight line gluing machine so that the carton is not required to be rotated or inverted to complete its construction. The gluing positions of the blanks are highlighted by hatching although it is envisaged that other embodiments of blank can be glued at other positions, if desired. The folding process is not limited to that described below and can be altered according to particular manufacturing requirements.

Thus, blanks 80 and 80*a* are secured to blank 10. In this embodiment, the flaps 94, 98 are secured to side panel 16 and medial panel 86 is secured to handle panel 38 by glue or other suitable means. Likewise, glue flaps 94*a* and 98*a* are secured to side panel 20 and medial partition panel 86*a* is secured to handle panel 52 by glue or other suitable means. Thus the carton is at a first stage of construction, shown in FIG. 2A. Thereafter, handle support panel 68 is folded about fold line 66 and into face contacting relationship with handle panel 52 so that apertures 70 and 58 are aligned. End panel 18 is folded out of alignment with the adjacent side panels 16, 20 along fold lines 30, 19, 32 respectively such that intermediate panels 50, 64 are in face contacting relationship with each part 18*a*, 18*b* of end panel respectively. In some embodiments, intermediate panels 50, 64 are secured to end panel 18 by glue or other suitable means in the art.

Medial support panels 12, 24 are also folded into face contacting relationship with respective end panels 14, 22 and handle panels 38, 58 and may be secured together by glue or other suitable means in the art. The outer panels 18*b*, 20, 22 forming one side of the partition are folded into face contacting relationship with the outer panels 18*a*, 16, 14 forming the other side of the partition.

By folding the panels in this way, the two sides of the basket carrier are brought into a face to face relationship with each other and the handle panels 52, 68 are secured together with the inner face of handle panel 38 by glue or other means known in the art. Preferably, tab 93*a* is secured to medial panel 86 and medial support panels 12, 24 may be secured to the portions of respective medial panels 86, 86*a* respectively by glue or other means known in the art. In those embodiments with flap 95*a*, it is secured to end panel 18.

The carton is then at an intermediate stage, shown in FIG. 2B: a completed collapsed article carrier whereby second end panel 22, second side panel 20 and outer handle panel 52 are placed in a face to face relationship with first end wall 14, first side panel 16 and handle panel 38 respectively. The carton of the first embodiment is commonly referred to as an "arrow profile" pack, because the end panels are folded about a central fold line to define a leading edge 37 and two trailing edges defined by fold lines 30 and 32.

To erect the article carrier, the leading and trailing edges of the collapsed carrier are moved inwardly towards each other. This causes end panels 14, 22 and 18, and side panels 16 and 20 moved from a flat collapsed condition into a substantially rectangular configuration which facilitates the construction of individual cells. Thus, transverse partition panels 82, 84 are automatically deployed by moving out of alignment with first side panel 16 and handle panel 38; and are folded about fold lines 88 and 92 respectively such that transverse partition panels 82, 84 are in a substantially perpendicular relationship with respect to handle panel 38 and side panel 16. As illustrated in FIG. 3, three cells C1, C2, C3 are thus formed. Similarly, transverse partition panels 82*a*, 84*a* are moved out of alignment with second side panel 20 and handle panel 52 and are folded about fold lines 88*a*, 92*a* respectively so that transverse partition panel 82*a*, 84*a* are in a perpendicular relationship with respect to handle panel 52 and side wall panel 20, so that three further cells are formed. In use, the transverse partition panels may separate and support the articles in adjacent cells.

The carton is then ready to receive articles which are loaded by relative vertical movement between the articles and carrier during forward feed movement well known in the art by which the articles enter their respective cells through the open bottom of the carrier. Alternatively, the bottles can enter their respective cells through the top of the carrier.

Thereafter, the base is formed whereby base panels 72 and 74 are brought into an overlapping relationship and connected together by securing means well known in the art. In this embodiment glue flap 76 is glued to base panel 74. The base panels may be held in place prior to loading and/or after loading by engagement of the base panels 72, 74 with the hooks 97, 97*a* shown in FIGS. 1 and 3.

In use, handle tabs 46, 60 are folded about handle panels 38, 52 to further secure hand structure H and the carton. Thus the carton of the first embodiment is in a set up condition as shown in FIG. 3 of the drawings.

Figures 4A, 4B:
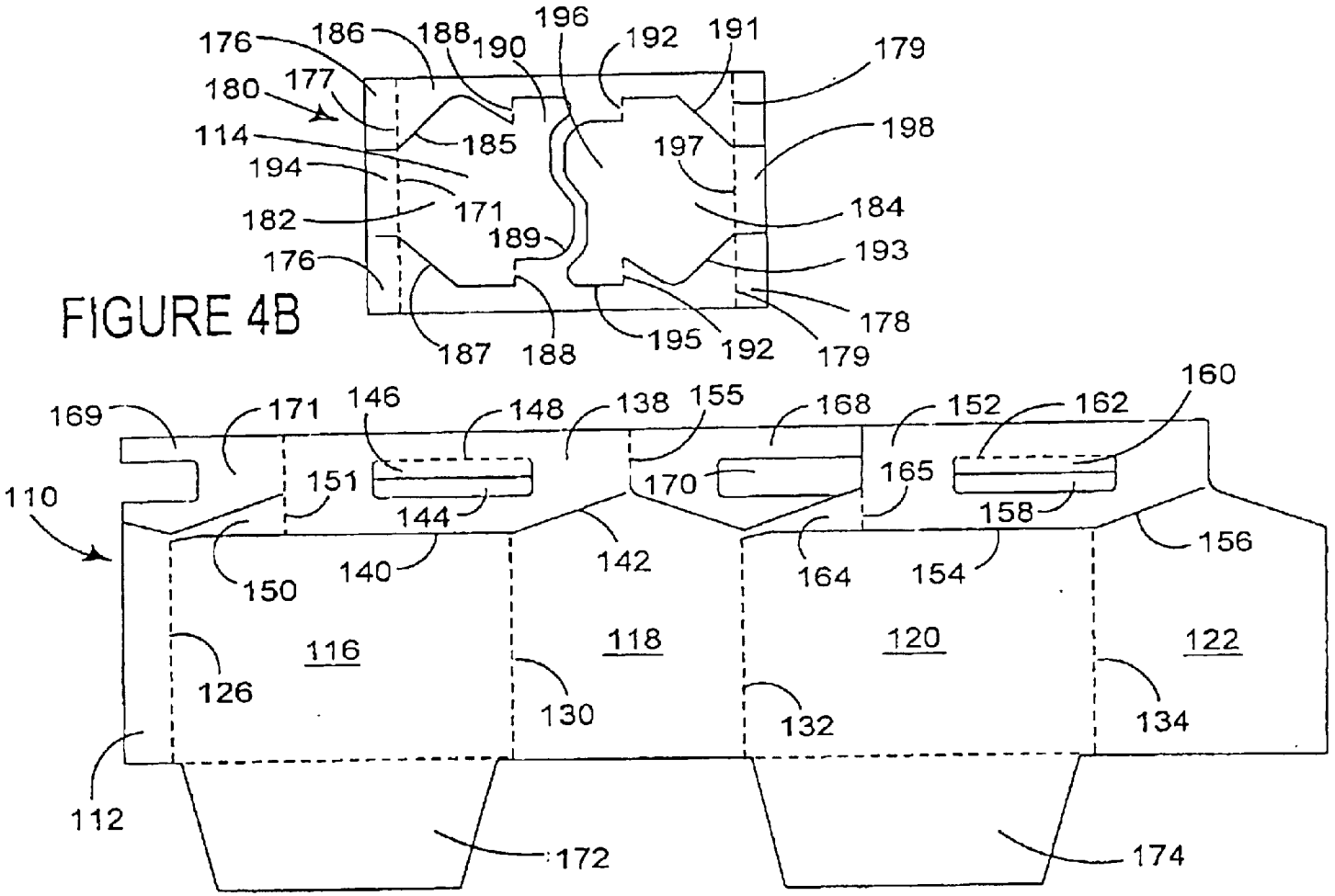
FIGS. 4A and 4B are plan views of blanks of paperboard from which an article carrier according to another embodiment of the invention is formed.

Turning to the construction of the second embodiment shown in FIGS. 4A and 4B there is shown an article carrier formed from a two part blank. The blanks are capable of forming a "parallelogram profile" pack, described below. Blank 110, shown in FIG. 4A, provides the outer panels of the carrier and includes in longitudinal series, a first medial support panel 112, first side panel 116, first end panel 118, second side panel 120 and second end panel 122 foldably connected one to the next along lateral fold lines 126, 130, 132, 134 respectively.

A first handle panel 138 is disposed adjacent first end panel 118 and first side panel 116 and is separated from the side and end panels by cut lines 140, 142 extending from fold line 126 and into end panel 118. Handle panel 138 is hingedly connected to an upper edge of end panel 118 by a nick portion. The point of connection should be in a central part, if it is desired for the handle to be centrally located. Handle panel 138 is foldably connected along its opposing edge to medial support panel 112 by an intermediate panel 150. In this embodiment, intermediate panel 150 is hingedly connected to a side edge of handle panel 138 along fold line 151, and to medial support panel along fold line 30 as shown in FIG. 4A. Handle panel 138 may include a hand aperture 144. In this embodiment, a hand cushioning flap 146 is connected along fold line 148 to an upper edge of hand aperture 44.

Preferably, a second handle panel 152 is provided which is disposed adjacent a second side panel 120 and second end panel 122 and is separated from the side and end panels by cut lines 154 and 156 respectively which extend from fold lines 132 and into end panel 122. Handle panel 152 is hingedly connected to an upper edge of end panel 122 by a nick portion and to the opposing end panel 118 by an intermediate panel 164. In this embodiment, intermediate panel 164 is foldably connected to a side edge of handle panel 152 along fold line 165 and to end panel 118 along fold line 132, shown in FIG. 4A. Second handle panel 152 includes a hand aperture 158. In this embodiment, a hand cushioning flap 160 is connected along fold line 162 to an upper edge of hand aperture 158.

In this embodiment, a triple ply handle structure is provided which includes a pair of handle support panels 168, 169. Each support panel 168, 169 is foldably connected to opposing side edges of handle panel 138 and are foldable so that the opposing side edges of each support panel are brought into abutment when the support panels are brought into face contacting relationship with handle panel 138. More particularly, handle support panel 168 is foldably connected to handle panel 138 along fold line 155 and includes a hand aperture 170, positioned intermediate upper and lower edges of handle support panel 168. Hand aperture 170 is positioned to be aligned with hand apertures 154, 158 in a set up carton. Similarly, handle support panel 169 includes hand aperture 171.

A base structure is formed from panels 172, 174 and securing means which in this embodiment is substantially the same as the first embodiment and is not, therefore described in any greater detail.

The partition structure of the article carrier is formed from a second blank 180. The blank 180 comprises a pair of transverse partition panels 182, 184 struck from a medial partition panel 186. Transverse partition panel 182 is struck from medial panel 186 by cut lines 185, 187 and 190 and is foldably connected thereto along interrupted fold line 188. It will be seen from FIG. 4B that interrupted fold line 188 is positioned intermediate the opposing ends of transverse partition panel 182 to define a two part partition panel, 114 and 189. Fold line 188 can be moved to any position intermediate the ends to alter the respective lengths of each part of the panel 182. Transverse partition panel 182 may further comprise glue flap 194 foldably connected thereto along fold line 195. Like the first embodiment, it is envisaged the number and position of the transverse panels can be altered according to the number of article receiving cells required.

Likewise, transverse partition panel 196 is struck from medial panel 186 by cut lines 191, 193 and 195 and is foldably connected thereto along fold line 192. Interrupted fold line 192 is disposed intermediate the opposing ends of transverse partition panel 184 to define a two part partition panel 115, 196. There may further comprise glue flap 198 foldably connected to transverse partition panel 184 along fold line 197.

There may further comprise medial glue flaps 176, 178 foldably connected to opposing side edges of medial panel 186 along fold lines 177 and 179 respectively.

The construction of the carton is substantially identical to that described in the fifth embodiment illustrated in FIGS. 10 to 13 below and is not, therefore, described in any greater detail.

Figure 4C:
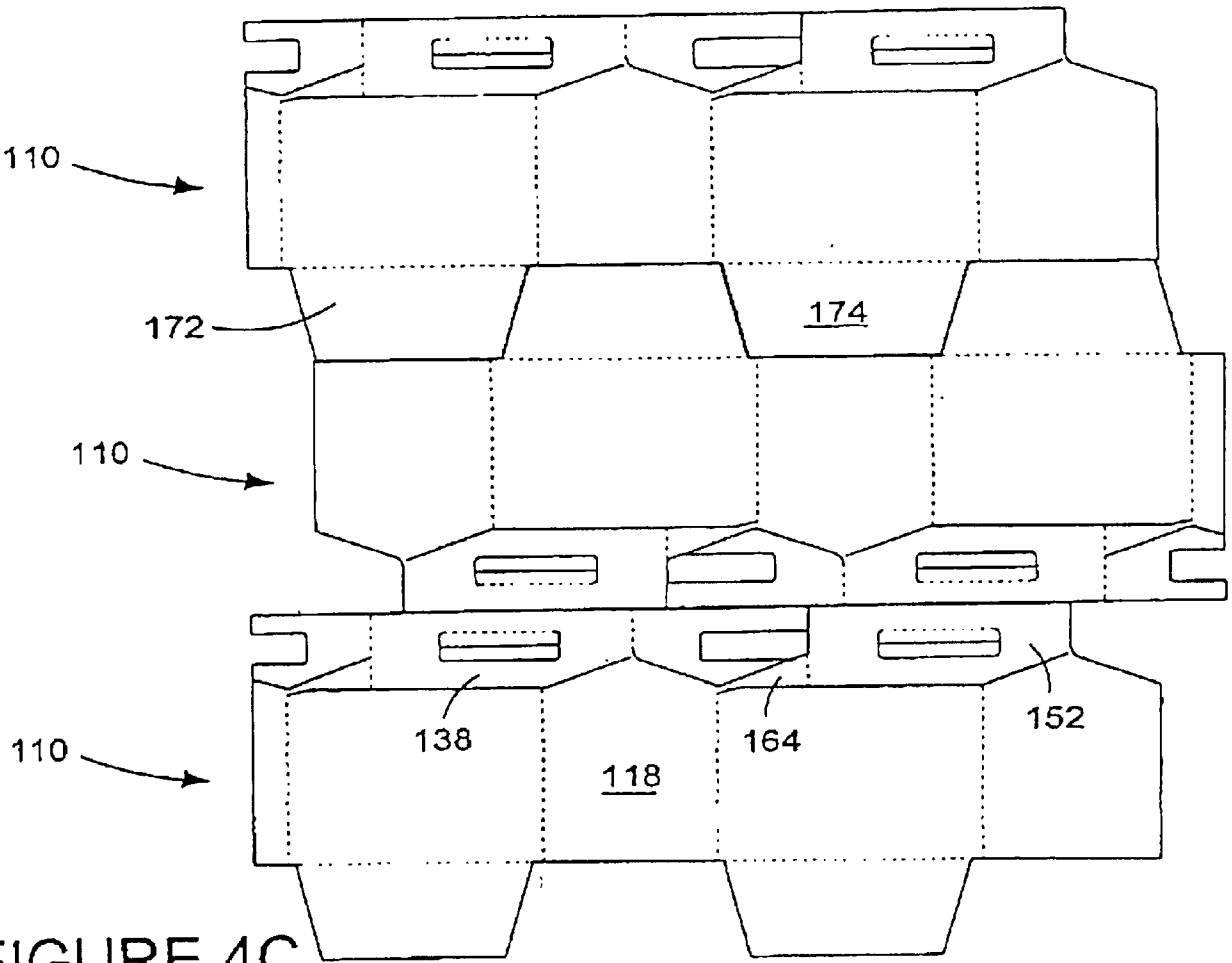
FIG. 4C is a plan view of adjacent blanks shown in FIG. 4A formed from a continuous roll of paperboard or similar sheet material.

A common feature shared by both the first and second embodiments relates to the handle panel structure H. More particularly, the handle panels and, as the case may be, the handle support panels are co-planar. The upper edges of the handle panels are co-linear as shown in FIGS. 1A and 4A, so as to minimise the paperboard wasted because adjacent blanks can be struck from a continuous roll with their respective upper edges in abutment. FIG. 4C illustrates adjacent blanks 110 of the second embodiment and it will be seen that an efficient use of board is achieved. Preferably, the base panels 172, 174 of the blanks are shapes to marry with base panels from the next adjacent blank: again to minimise the board wastage.

The construction of the third embodiment is described by reference to FIGS. 5A, 5B, 6, 7A, 7B and 8. As shown in these drawings an article carrier formed from a three part blank the carrier, is an "arrow profile" pack, similar to the first embodiment described above and therefore, like panels are designated by the same reference numeral prefixed by the numeral "2". Therefore only the differences between the first and third embodiments are described in more detail.

Figure 5B:
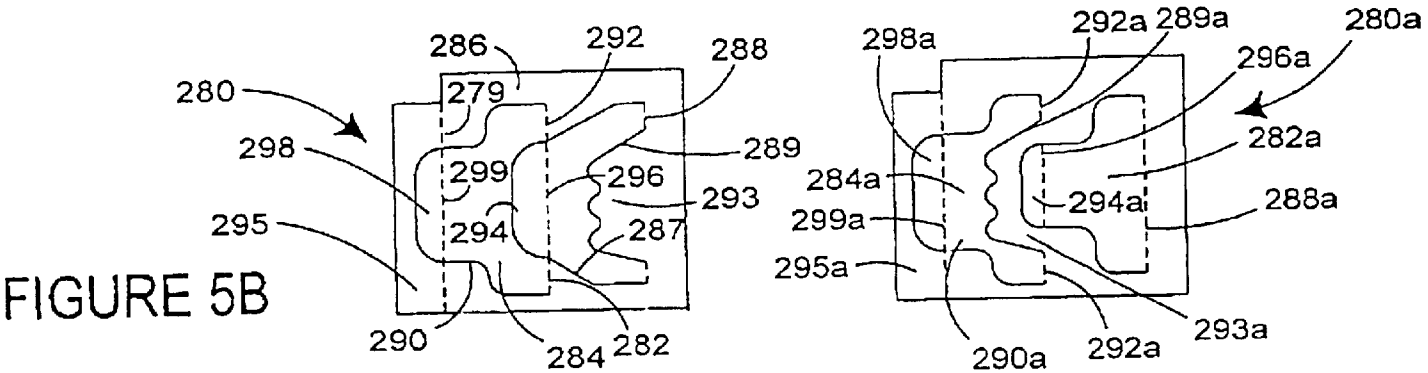
FIGS. 5A and 5B are plan views of blanks of paperboard from which an article carrier according to a third embodiment of the invention is formed.
Figure 5A:
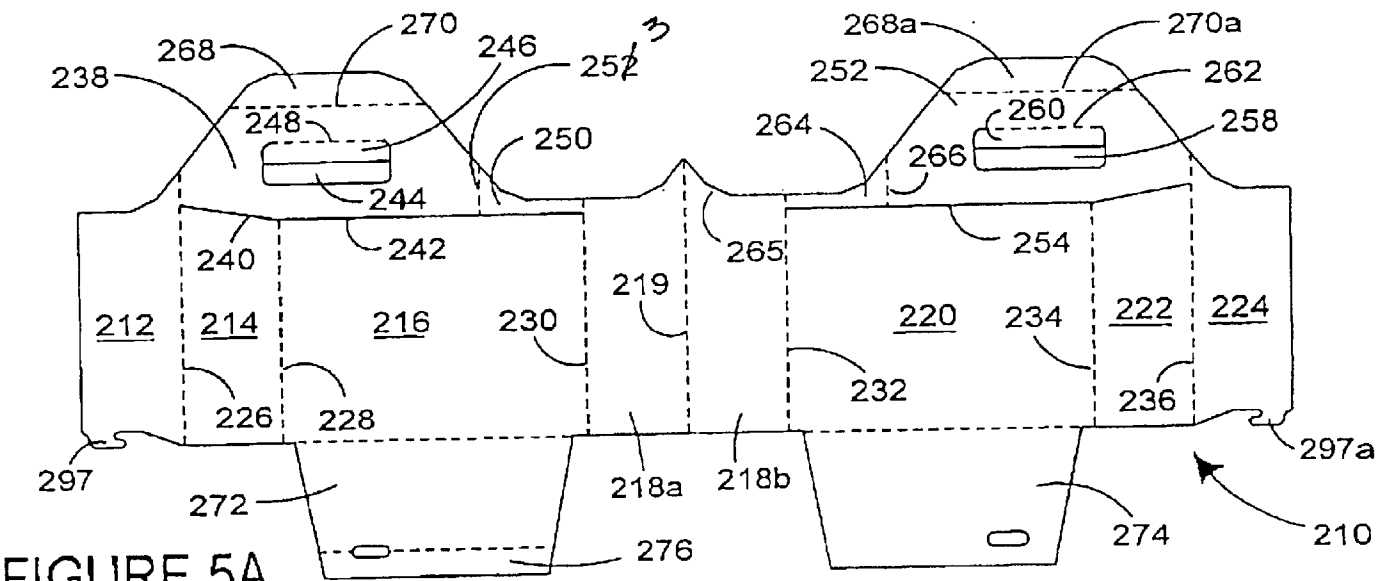

It will be seen from FIG. 5A that medial support panels 212, 224 are, in this embodiment wider, to provide a large surface to be secured to the corresponding medial panels 286, 286*a*.

In this embodiment, hooks 297 and 297*a* are provided along lower edge of medial support panels 212 and 224 to be engaged in corresponding apertures in the base structure, thereby to maintain the carton in a set up condition prior to loading and/or after loading.

In this embodiment, the handle H (FIG. 8) is a four ply structure provided by outer handle panels 238, 252 and handle support flaps 268 and 268*a* shown in FIG. 5A. Each handle flap 268 and 268*a* is foldably connected to an upper edge of corresponding handle panel 238, 252 along fold lines 270 and 270*a* respectively to be foldable about their respective fold lines so that, during construction, the handle support flaps can be placed into face contacting relationship with their adjacent handle panel, shown in FIG. 7B.

The blanks 280, 280*a* for forming the medial transverse partition structures, shown in FIG. 5B, differ from the blanks 80, 80*a* of the first embodiment blanks in that there comprises medial support flaps 295 and 295*a* that are foldably connected to medial panels 286 and 286*a* respectively along fold lines 279 and 279*a*. There may further comprise tab 293 struck from medial panel 286 and tab 293*a* struck from medial panel 296*a*. Each tab 293, 293*a* is adapted to be secured to the other medial panel 286*a*, 286 by glue or other suitable means, which is illustrated in more detail in FIG. 7B. The profile of the free edge of tabs 293, 293*a* is defined by cut lines 289 and 289*a*, which in this embodiment include three protruding elements to enlarge the surface area to separate adjacent cells.

Figure 6:
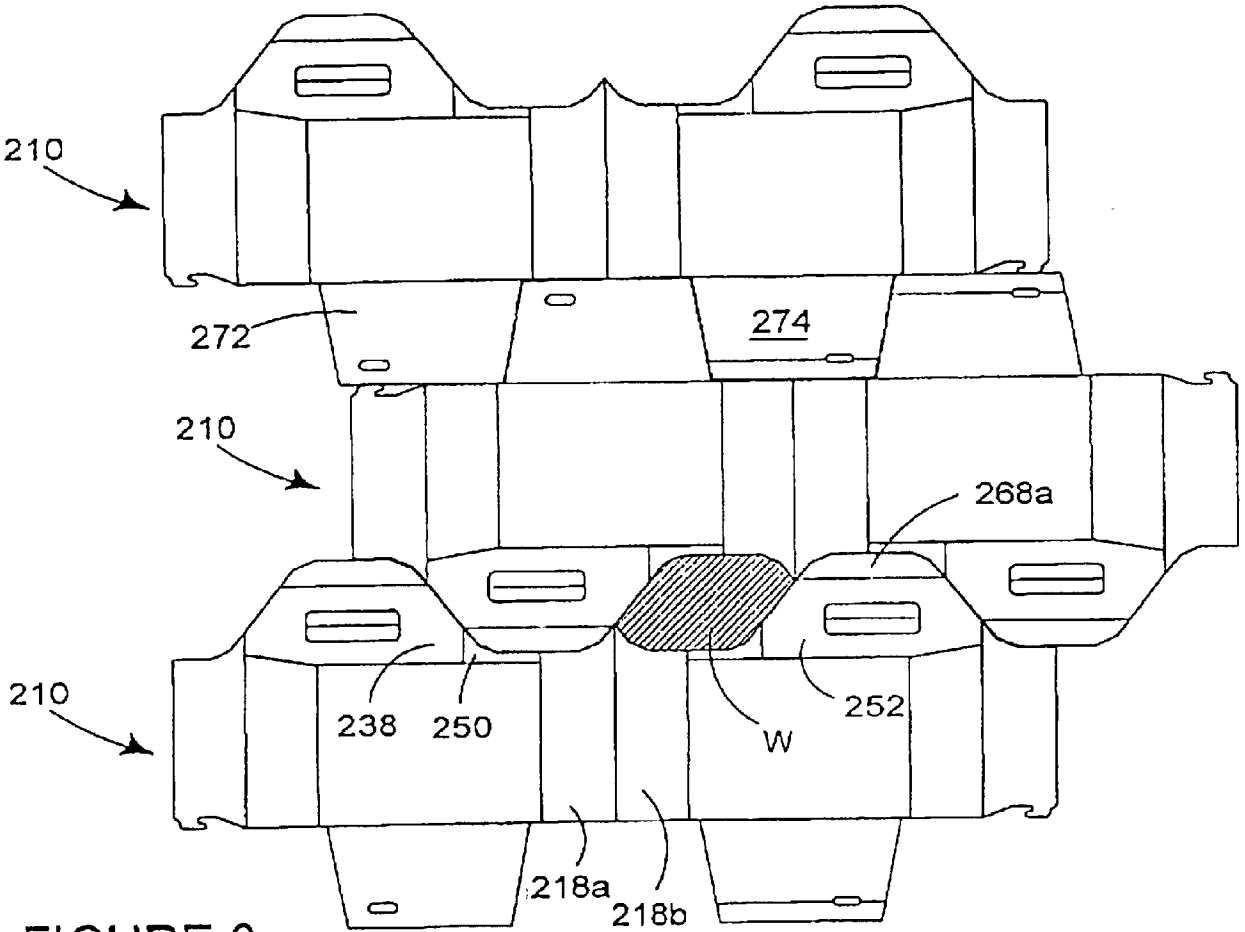
FIG. 6 is a plan view of adjacent blanks shown in FIGS. 5A and 5B formed from a continuous roll of paperboard or similar sheet material.

The shape of the upper edges of the blank and more particularly the handle support panel 268, handle panel 238 and intermediate panel 250 and end panel 218*a* are shaped to receive the corresponding panels of the next adjacent blank 210. As illustrated in FIG. 6, adjacent blanks are struck from a continuous roll of sheet material whereby adjacent blanks are formed as mirror images, such that they marry together thereby achieving an efficient use of the paperboard. Thus, in this embodiment, the waste material is illustrated by hatch section marked by the letter W. Beneficially, the shape of the handle structure minimises the amount of paperboard wasted and, advantageously provides aesthetically pleasing shape of handle.

Preferably, the shape of the base panels 274, 272 are substantially trapezoidal so that the lower edges of adjacent blanks marry up thereby to minimise the amount of board required.

Figure 7A:
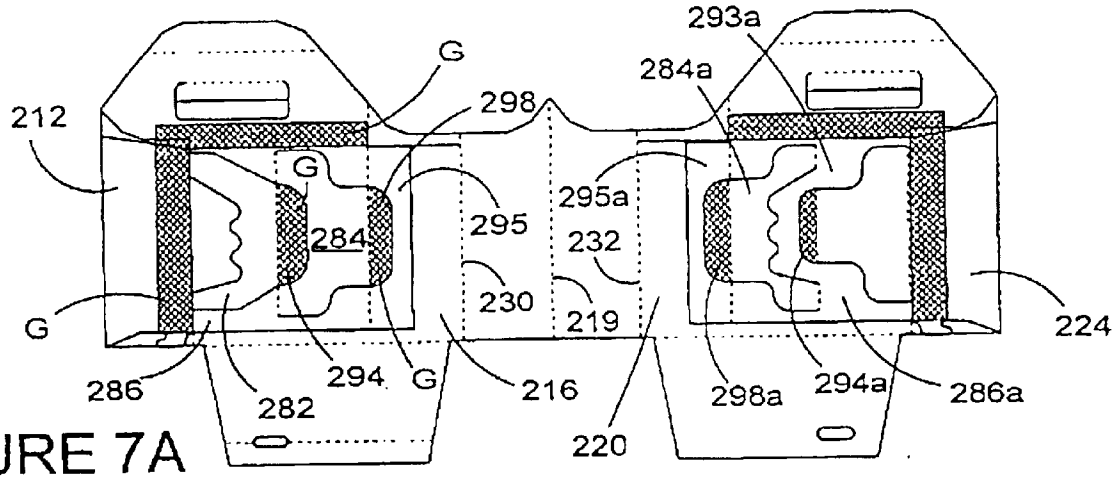
FIGS. 7A and 7B are side elevation views of the blanks shown in FIGS. 5A and 5B during construction to form a flat collapsed carton.

The construction of the third embodiment is similar to the first embodiment whereby the medial support panels 212, 224 are folded into face contacting relationship the medial panel 286 is secured to medial support panel 212, handle panel 238 and glue flaps 294, 298 are secured to side panel 216, but medial panel is otherwise unconnected to blank 210, as shown in FIG. 7A. Likewise, medial panel 286*a* is secured to medial support panel 224, handle panel 252 and the glue flaps 294*a* and 298*a* are secured to side panel 220. Thus, the carton is at a first stage of construction, shown in FIG. 7A.

Figure 7B:
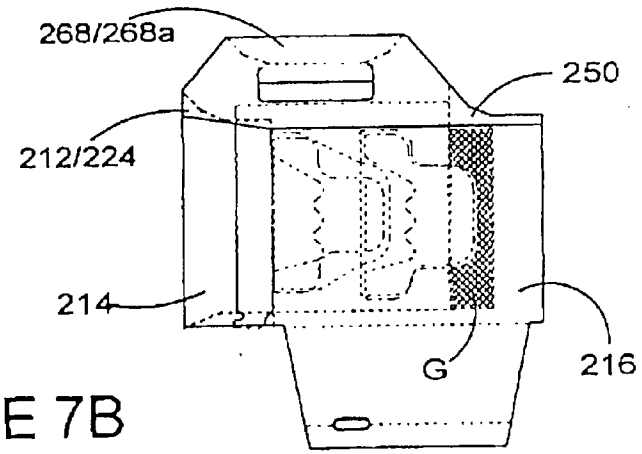
Figure 8:
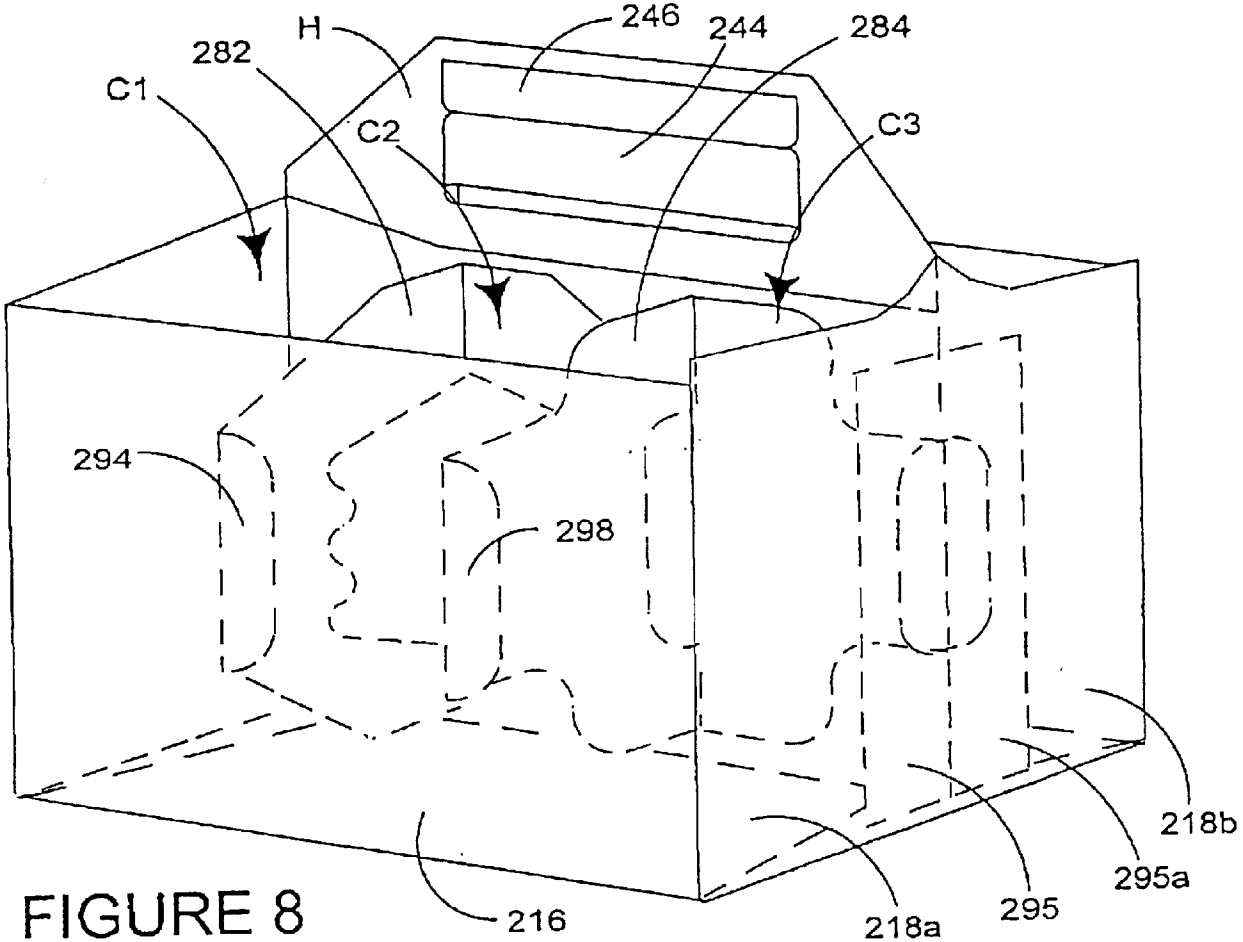
FIG. 8 is a perspective view of an erected basket carrier formed from the blanks shown in FIGS. 5A and 5B viewed from above and from one end.

Thereafter the blank is folded about fold lines 230, 219 and 232 so that second end panel 222, second side panel 220 and second handle panel 252 are placed in a face to face relationship with first end wall 214, first side panel 216 and handle panel 238 respectively to provide a package in a flat collapsed condition in an "arrow profile" and lead edge is defined by fold line 226, 236 and there comprises two trailing edges defined by fold lines 230 and 232 respectively. In those embodiments with medial support flaps 295 and 295*a* they are secured to end panel 218 as shown in FIG. 7B.

To erect the article carrier, the leading and trailing edges of the collapsed carrier moved inwardly towards each other, as described above in the first embodiment to construct the individual cells. The articles enter their respective cells C1, C2, C3 to complete the load process, ready to be supplied to the user, and the handle structure H and base structure are also formed in like manner to provide a carton similar to that illustrated in FIG. 8.

Figures 9A, 9B:
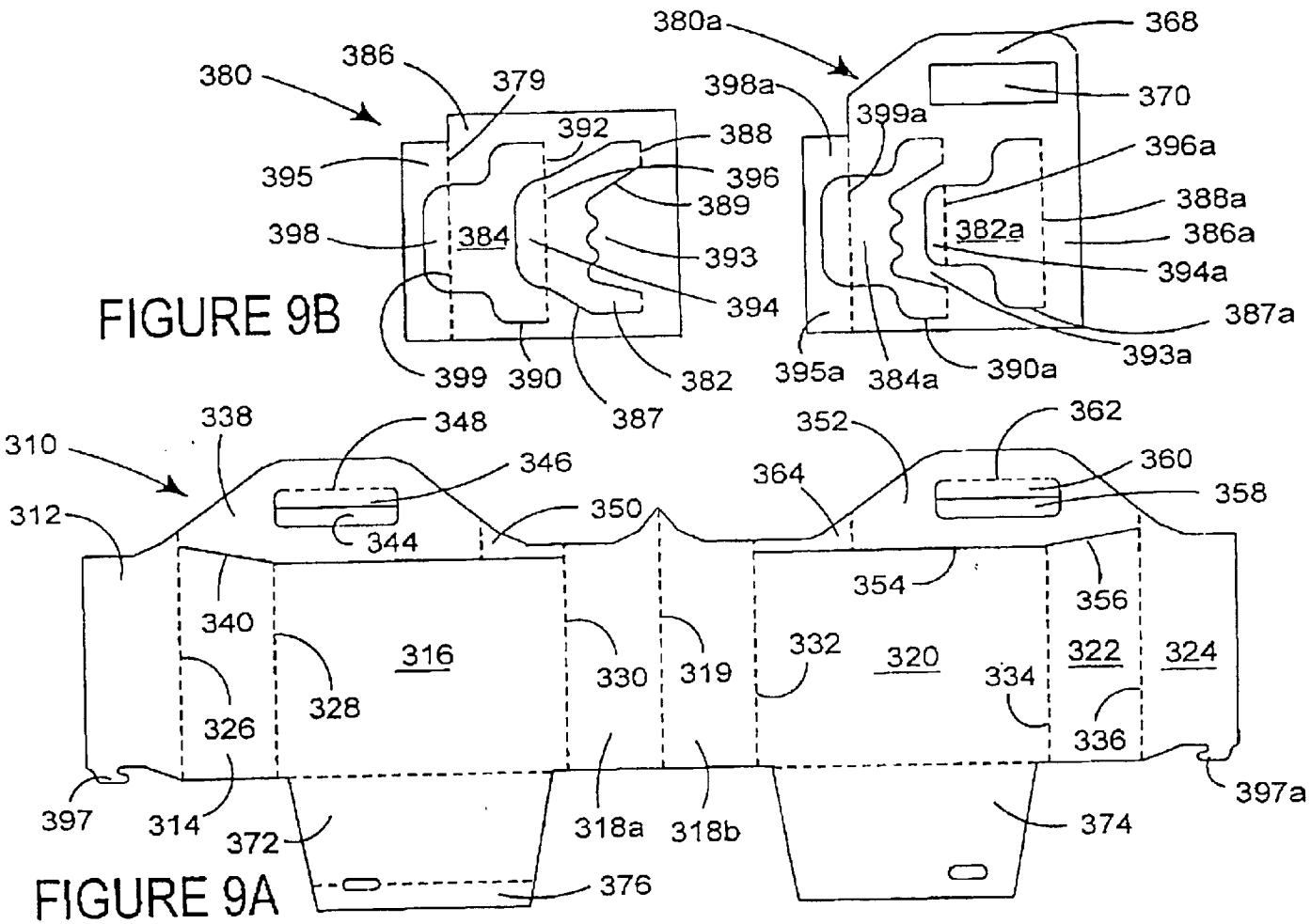
FIGS. 9A and 9B are plan views of blanks of paperboard from which an article carrier according to a fourth embodiment of the invention is formed.
Figures 10A, 10B:
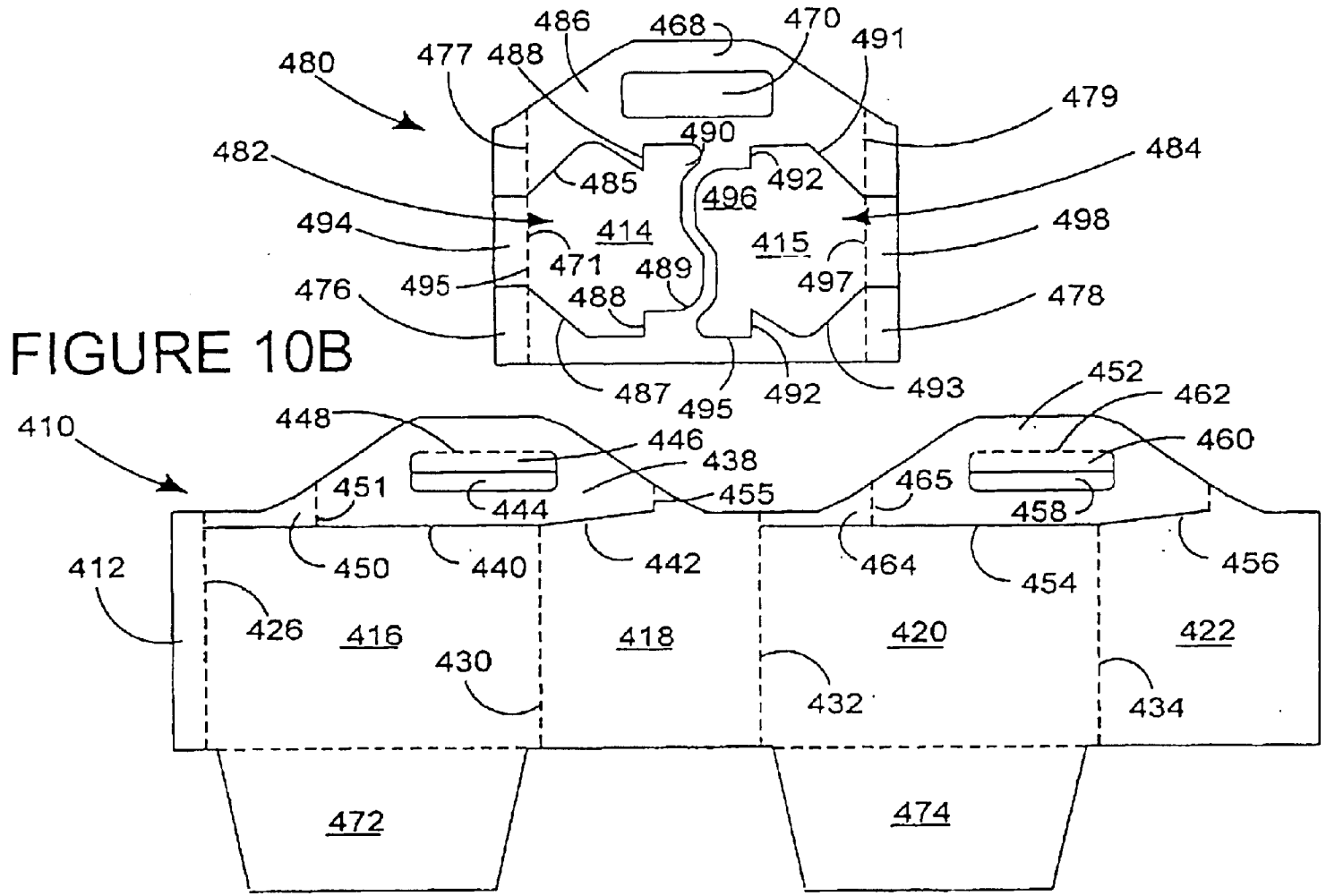
FIGS. 10A and 10B are plan views of blanks of paperboard from which an article carrier according to a fifth embodiment of the invention is formed.

The fourth embodiment of the carton is illustrated in FIGS. 9A and 9B. As shown in these drawings an article carrier formed from a three part blank the carrier, is an "arrow profile" pack, similar to the third embodiment described above and therefore like panels are designated by the same reference numeral prefixed by the numeral "3" to replace numeral "2". Therefore only the differences between the third and fourth embodiments are described in more detail. It can be seen from FIG. 9A that the handle is a triple ply structure, provided by outer handle panels 338, 352 formed from blank 310 and a handle support panel 368 formed from one of the medial panels 386*a*. There may further comprise a hand aperture 370 struck from handle support panel 368 to be aligned with hand apertures 344 and 358. The construction of the fourth embodiment is substantially the same as the third embodiment and is not therefore described in any more detail. Of course, the advantages of the third embodiment apply to the fourth embodiment. Furthermore, the handle structure of this embodiment results in a shorter folding time because there are no handle support panels connected to handle panels 338, 352 that need to be folded.

The fifth embodiment is illustrated by reference to FIGS. 10A, 10B, 11, 12A, 12B and 13. Turning first to the features of the fifth embodiment of article carrier by reference to FIGS. 10A and 10B there is shown two part blank. The blanks are capable of forming a "parallelogram profile" pack similar to the second embodiment described above and, therefore, like panels are designated by the same reference numeral but prefixed by the numeral "4" instead of "1". Therefore, only the differences between the second and fifth embodiments are described in any greater detail. It will be seen from FIG. 10A that the handle H is a triple ply structure, provided by outer handle panels 438 and 452 formed from blank 410. The handle support panel 468 is formed from the medial panel 486 and may further comprise a hand aperture 470 so positioned to be aligned with hand apertures 444 and 458 in a set up carton. Beneficially, the handle structure of this embodiment enables the handle to be formed quicker because there are no handle support panels connected to the handle panel, that need to be folded.

Figure 11:
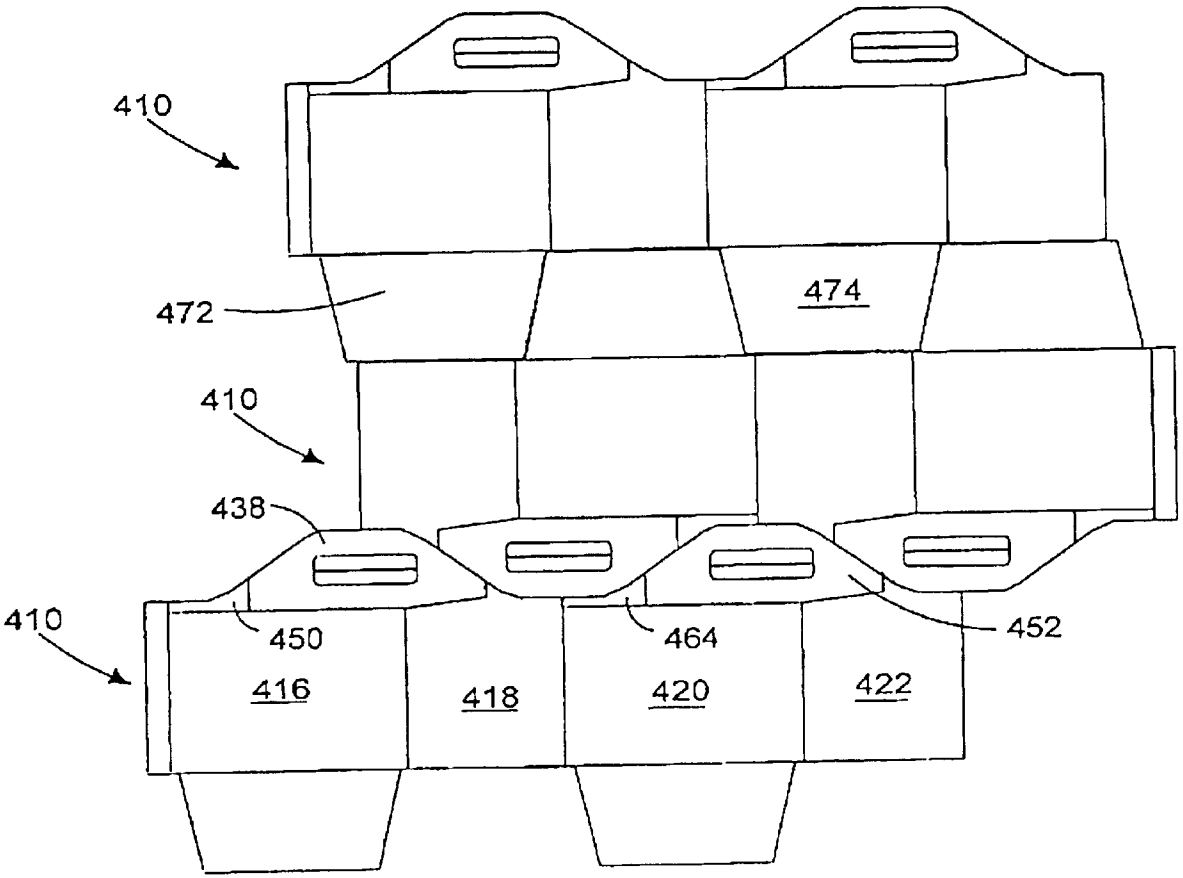
FIG. 11 is a plan view of adjacent blanks shown in FIG. 10A formed from a continuous roll of paperboard or similar sheet material.

The shape of the upper edges of the blank 410 and more particularly handle panels 438, 452, intermediate panels 450, 464 and end panels 418 and 422 are shaped to receive corresponding panels of the next adjacent blank 410. As illustrated in FIG. 11, adjacent blanks are struck from a continuous roll of sheet material whereby adjacent blanks are formed as mirror images, such that they marry together, thereby achieving efficient use of the paperboard. Beneficially, the shape of the handle structure minimises the amount of paperboard wasted and advantageously, provides aesthetically pleasing shape of handle. Preferably the shape of the base panels 472, 474 are substantially trapezoidal so that the lower edges of the blank marry up thereby to minimise the amount of board required.

Figure 12A:
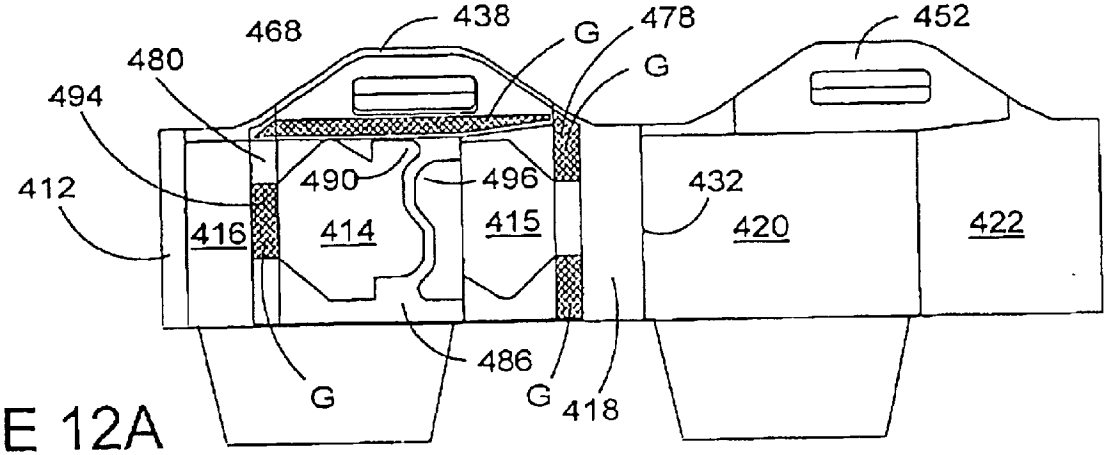
FIGS. 12A and 12B are side elevation views of the blanks shown in FIGS. 10A and 10B during construction to form a flat collapsed carton.
Figure 12B:
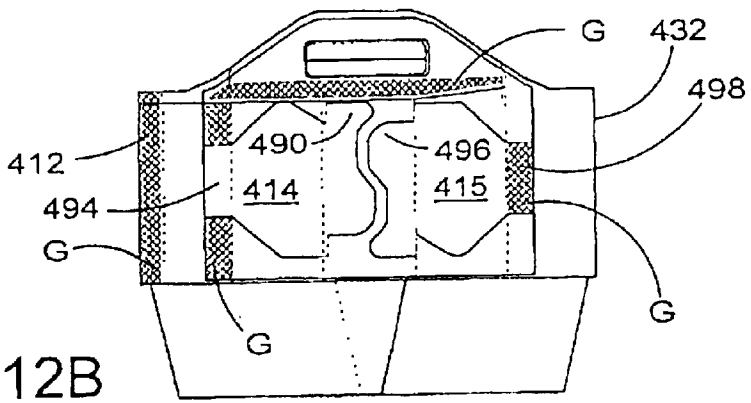
Figure 13:
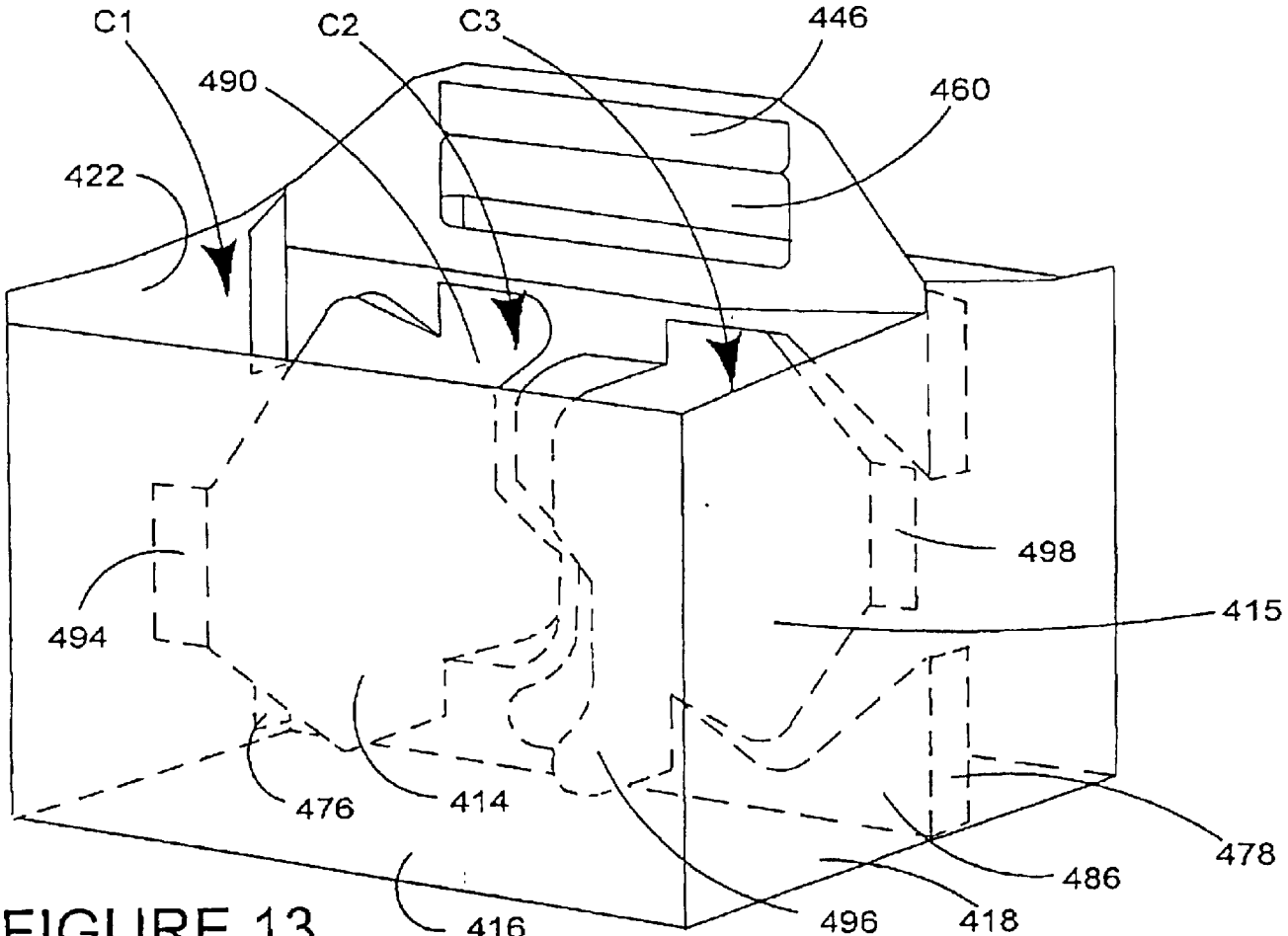
FIG. 13 is a perspective view of an erected basket carrier formed from the blank shown in FIG. 10A viewed from above and from one end.

The construction of the completed carrier of the fifth embodiment shown, in FIGS. 12*a*, 12*b* and 13, from a blank form to a flat collapsed condition and into a set up carton a series of sequential folding and gluing operations which can be performed in a straight line gluing machine, so that the carton is not required to be rotated or inverted to complete its construction. The gluing positions of the blanks are highlighted by hatching, although it is envisaged that other blanks can be glued at other positions if desired. The folding process is not limited to that described below and can be altered according to particular manufacturing requirements.

Thus, blank 480 is secured to blank 410. In this embodiment, glue flap 494 is secured to side panel 416 and medial panel 486 is secured to handle panel 438 so that handle support panel 468 is aligned with handle panel 438. Medial support flap 478 is secured to end panel 418 by glue or other suitable means known in the art. Thus, the carton is at a first stage of construction shown in FIG. 12A. Thereafter glue flap 412 is folded about fold line 426 into face contacting relationship with side panel 416 and the outer panels 420 and 422 are folded about fold line 432 into face contacting relationship with medial panel 406. End panel 422 is secured to glue flap 412 and transverse glue flap 498 is secured to side wall 420. Handle panel 452 is secured to the opposing face of handle support panel 468 and medial support panel 476 is secured to end panel 422.

By folding and securing the panels in this way the two sides of the basket carrier are brought into face to face relationship such that the article carrier is in a completed and collapsed condition, shown in FIG. 12B, to be supplied to the end user of the carton, for example a bottler. The carton of the fifth embodiment is, commonly, referred to as a "parallelogram profile" pack because the leading edge is defined by fold line 432 and the trailing edge is defined by diametrically opposed edge provided by fold line 426.

To erect the article carrier, the leading and trailing edges of the collapsed carrier are moved inwardly towards each other, this causes end panels 422 and 418 and side panels 416 and 420 to be moved from a flat collapsed condition into a rectangular configuration which facilitates automatic construction of the individual cells. Thus, transverse partition panels 482 and 484 are moved out of alignment with first and second side panels 416, 420 respectively and are folded about fold lines 488 and 492 such that the transverse partition panels are in a substantially perpendicular relationship with respect to handle panel 468 and side panels 416 and 420. It will be seen from FIG. 13 that each part 414, 490; 415, 496 extends from each side of the medial panel to form two rows of three cells C1, C2, C3. In effect, fold lines 488, 492 act as pivot points for the partition panels. In use, the transverse partition panels may separate and support the articles in adjacent cells.

The carton is then ready to receive articles which are loaded a relative vertical movement between the articles and the carrier during forward feed movement well known in the art by which the articles enter their respective cells through the open bottom of the carrier. Alternatively, the bottles can enter their respective cells through the top of the carrier. Thereafter the base is formed in substantially the same manner as described above whereby base panels 472, 474 are connected together by securing means. Similarly handle tabs 446, 460 are folded about handle 468, 452 to further secure hand structure H and the carton. Thus the carton of the fifth embodiment is in a set up condition as shown in FIG. 13 of the drawings.

The sixth embodiment of the invention is illustrated in FIGS. 14A, 14B, 15A, 15B and 16. As shown in these drawings an article carrier is formed from a three part blank: the carrier is a parallelogram profile pack similar to the fifth embodiment described above and therefore like panels are designated by the same reference numeral prefixed with the numeral "5" instead of "4". Therefore only the differences between the sixth and fifth embodiments are described in more detail.

Figure 14B:
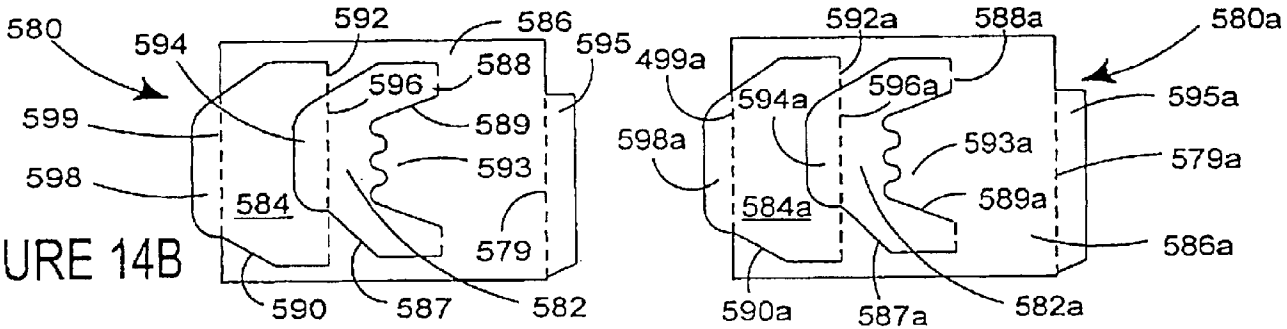
FIGS. 14A and 14B are plan views of blanks of paperboard from which a basket carrier according to an sixth embodiment of the invention is formed.
Figure 14A:
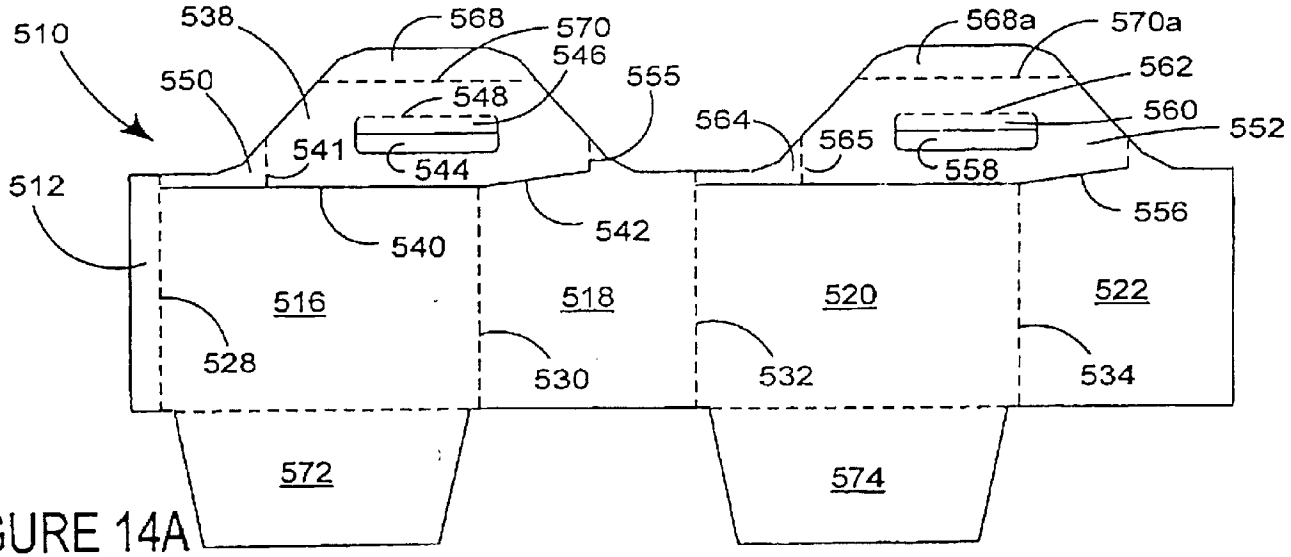

As regards the blank 510 for forming the outer panels, it will be seen from FIG. 14A that the handle is a four ply structure provided by outer handle panels 538, 552 and handle support flaps 568 and 568*a*. Each handle flap 568, 568*a* is foldably connected to an upper edge of corresponding handle panel 538, 552 along fold lines 570, 570*a* respectively to be foldable about their adjacent fold lines so that, during construction, the handle flaps can be placed in face contacting relationship with their adjacent handle panel, shown in FIG. 15B.

A two part blank 580, 580*a* is provided for forming the medial and transverse partition structures shown in FIG. 14B and is substantially similar to the third embodiment illustrated in FIG. 5B. It will be seen that the position of tabs 593, 593*a* differ from the third embodiment although each tab is adapted to be secured to the other medial panel 586, 582 by glue or other suitable means known in the art and to separate adjacent cells. In this embodiment, the protruding elements E of each tab overlap to be secured together, shown in FIG. 15B.

Figure 15A:
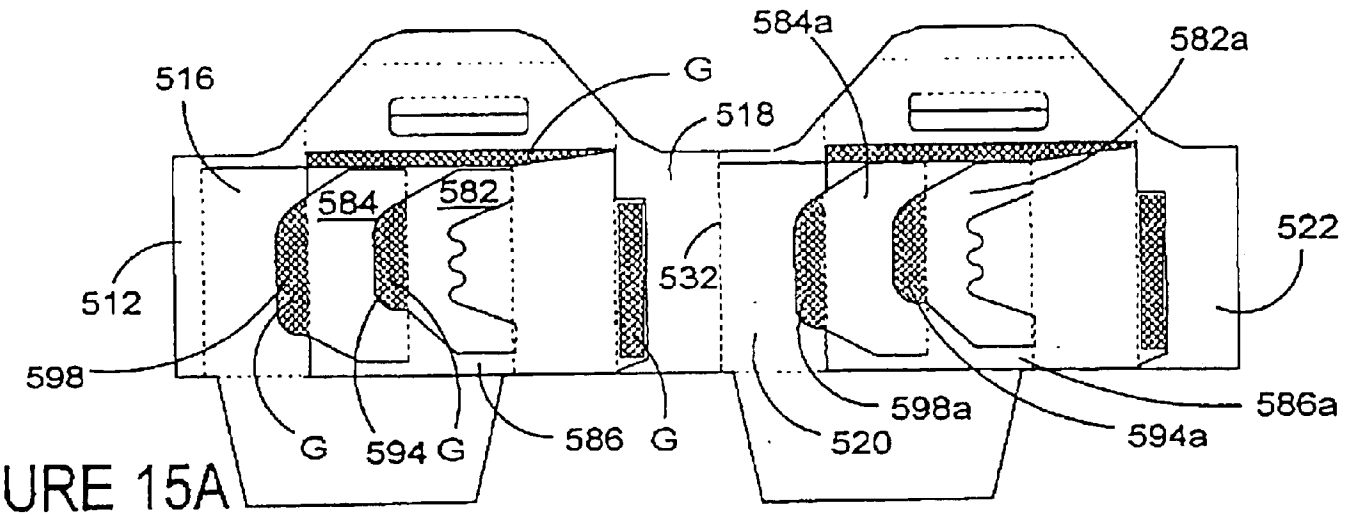
FIGS. 15A and 15B are side elevation views of the blanks shown in FIGS. 14A and 14B during construction to form a flat collapsed carton.
Figure 15B:
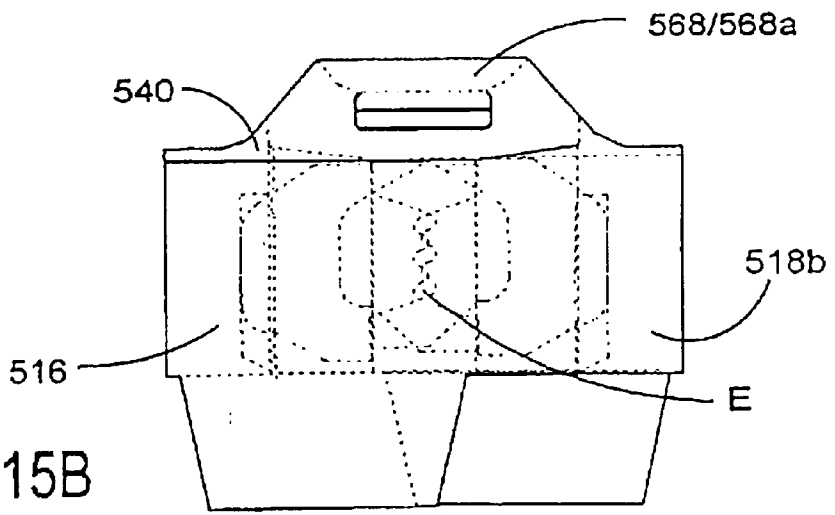
Figure 16:
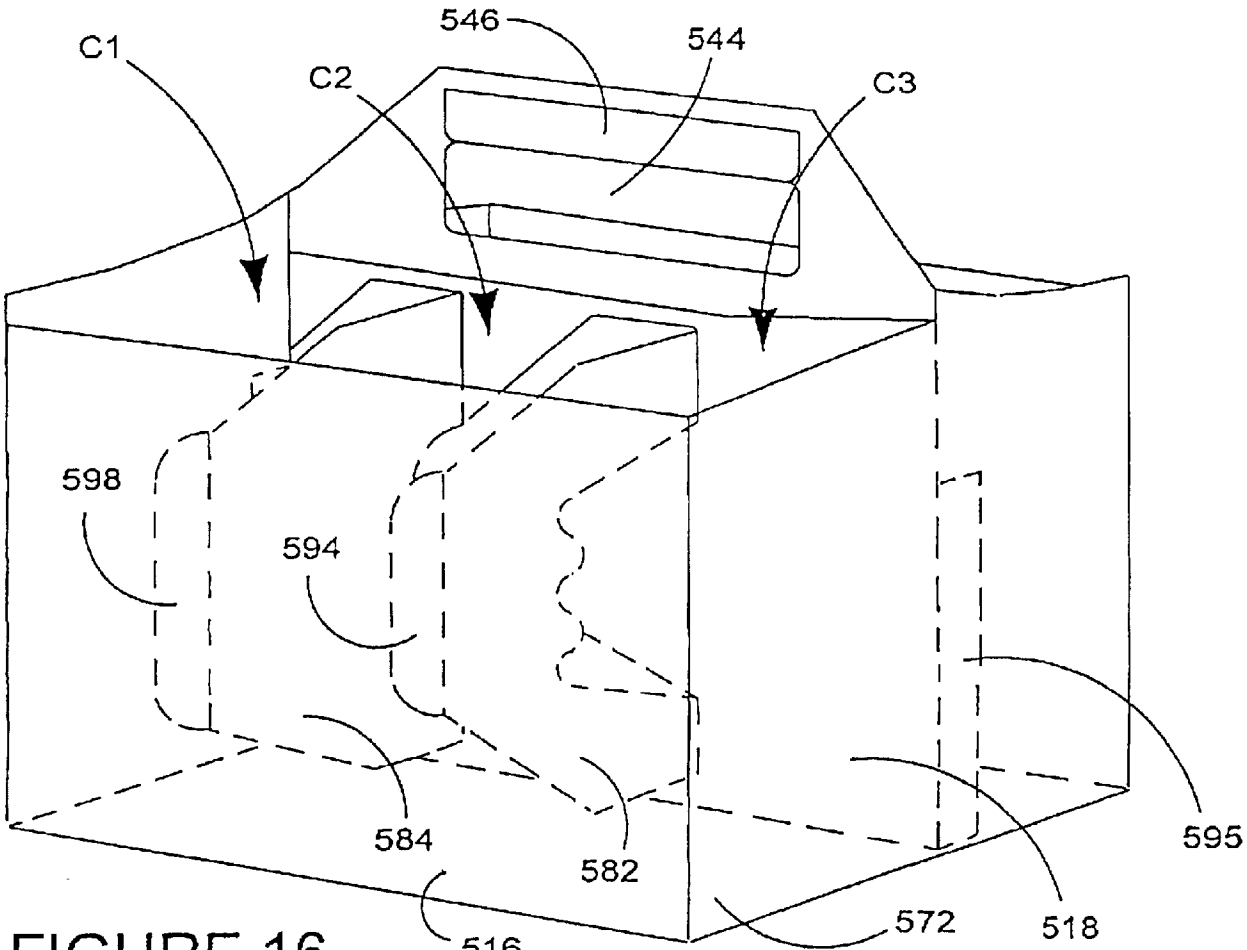
FIG. 16 is a perspective view of an erected basket carrier formed from the blank shown in FIG. 14A viewed from above and from one end.

The construction of the sixth embodiment is similar to the fifth embodiment described above whereby the transverse partition panels are secured to respective side panels, the medial panel is secured to the handle panel and the medial support flaps secured to respective end panels shown in FIG. 15A. Thereafter one side of the basket carrier is folded about fold line 532 into face contacting relationship with the medial structure and is secured together as described above to form a flat collapsed carrier illustrated in FIG. 15B.

To erect the carrier of the sixth embodiment, the leading and trailing edges of the collapsed carrier move inwardly towards each other as described above in the fifth embodiment to construct individual cells and the articles enter their respective cells C1, C2, C3 to complete the loading process, ready to be supplied to the user. The handle structure H and base structure are also formed in like manner to provide a fully erected carton similar to that illustrated in FIG. 16. The advantages of the shape of the upper edges of the blank and base of the present embodiment have already been referred to in respect of the fifth embodiment above and are not therefore described in any greater detail.

The seventh embodiment of the invention is illustrated in FIG. 17A, 17B, 18A, 18B and 19. As shown in these drawings an article carrier is formed from a three part blank: the carrier is a parallelogram profile pack similar to the sixth embodiment described above and therefore like panels are designated by the same reference numeral prefixed with the numeral "6" instead of "5". Therefore only the differences between the seventh and sixth embodiments are described in more detail.

Figures 17A, 17B:
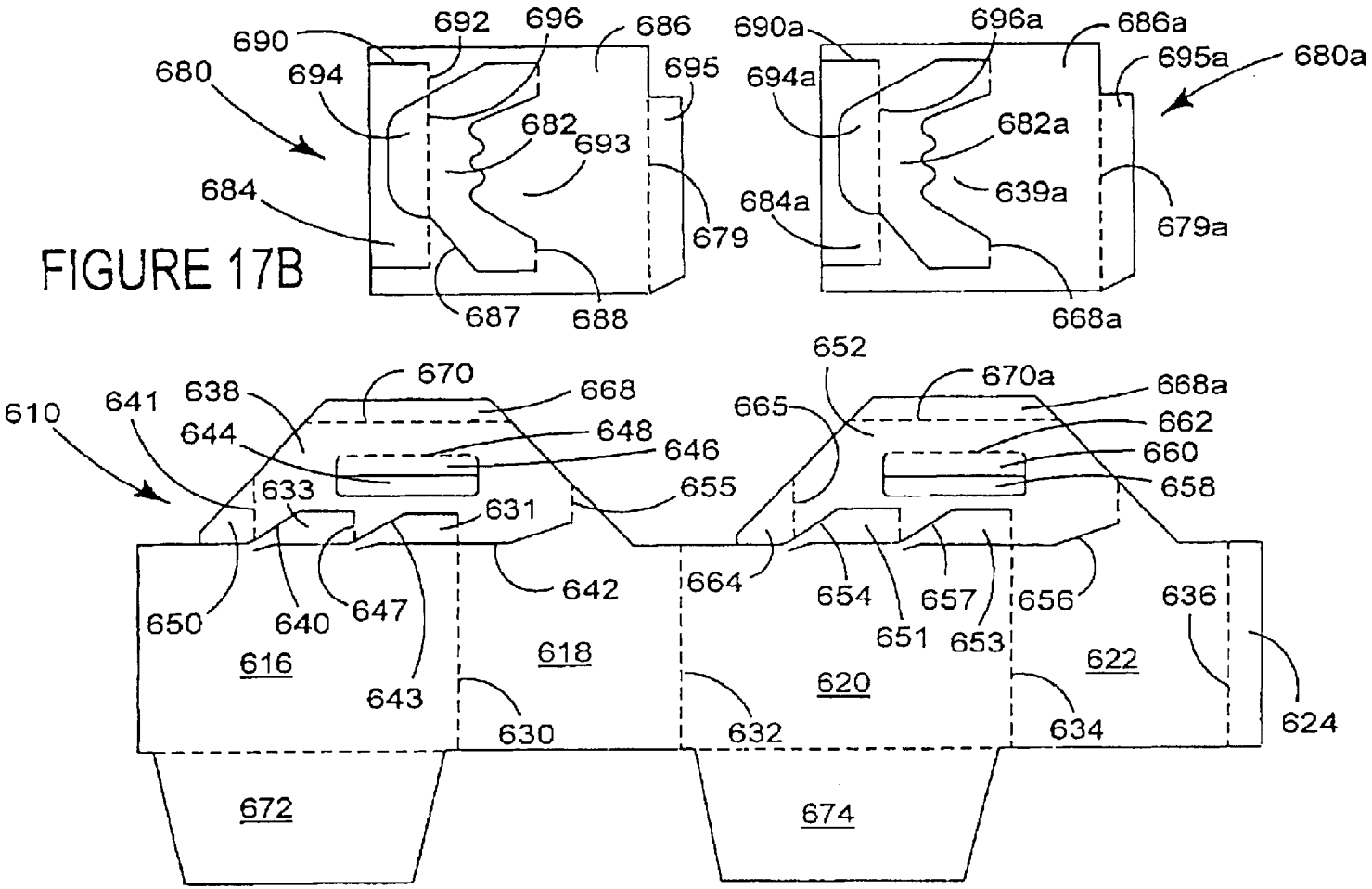
FIGS. 17A and 17B are plan views of blanks of paperboard from which a basket carrier according to the seventh embodiment of the invention is formed.

It can be seen from FIG. 17A that the handle is a four ply structure provided by outer handle panels 638, 652 and handle support flaps 668 and 668*a*. Each handle flap 668, 668*a* is foldably connected to an upper edge of corresponding handle panel 638, 652 along fold lines 670, 670*a* respectively to be foldable about their adjacent fold lines so that, during construction, the handle flaps can be placed in face contacting relationship with their adjacent handle panel, shown in FIG. 18B.

In this embodiment, the outer blank further comprises a pair of transverse partition panels 631, 633 foldably interconnecting handle panel 638 and side panel 616. There further comprises a pair of transverse partition panels 651, 653 foldably interconnecting handle panel 652 and side panel 620. Glue flaps 650 and 664 are provided to be secured to the adjacent end panel 622, 618 respectively.

A two part blank 680, 680*a* is provided for forming the medial and transverse partition structures shown in FIG. 17B and is substantially similar to the third embodiment illustrated in FIG. 5B. Therefore, only the differences are described. The transverse partition panels 682, 684; 682*a*,

684*a* are constructed in a different manner and, indeed, it is not necessary for glue flaps to be included because these panels can be secured to panels 631, 633; 651, 653 respectively. It will be seen that the position of tabs 693, 693*a* differ from the third embodiment although each tab is adapted to be secured to the other medial panel 686, 686*a* by glue or other suitable means known in the art by the protruding elements shown in FIG. 18B.

Figure 18A:
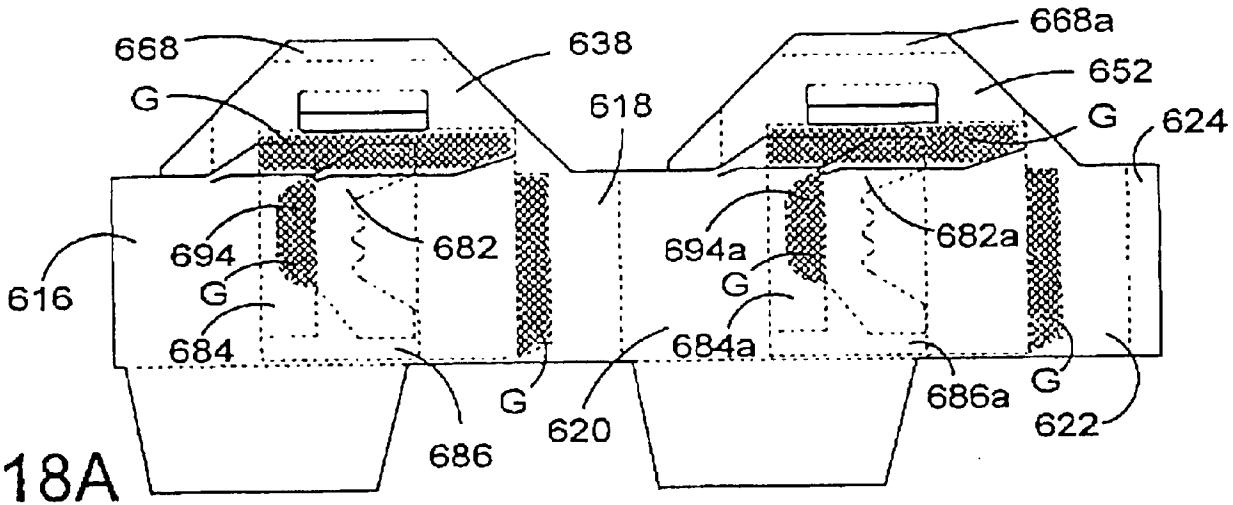
FIGS. 18A and 18B are side elevation views of the blanks shown in FIGS. 17A and 17B during construction to form a flat collapsed carton.
Figure 18B:
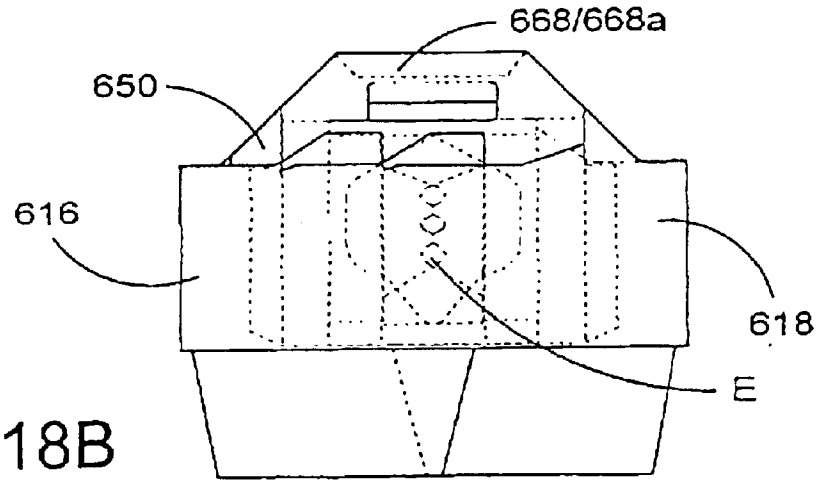
Figure 19:
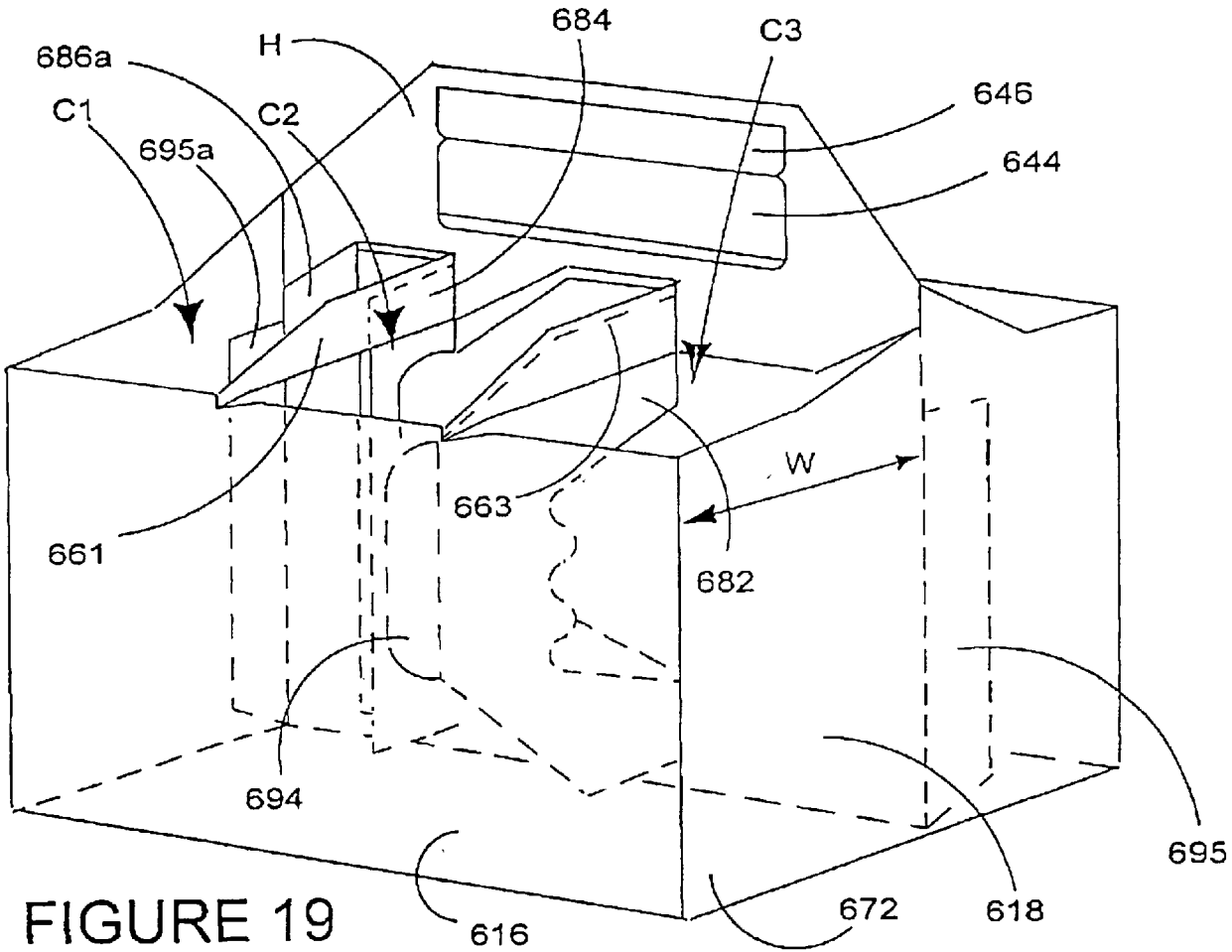
FIG. 19 is a perspective view of an erected basket carrier formed from the blank shown in FIG. 17A viewed from above and from one end.

The construction of the seventh embodiment is similar to the some of the preceding embodiments described above, whereby the transverse partition panels are secured to respective side panels, the medial panel is secured to the handle panel and the medial support flaps secured to respective end panels shown in FIG. 18A. Furthermore, the transverse partition panels 684, 682; 684*a*, 682*a* are secured to the adjacent transverse partition panels 633, 631; 651, 653 of the outer blank 610. Thereafter one side of the basket carrier is folded about fold line 632 into face contacting relationship with the medial structure and is secured together as described above to form a flat collapsed carrier illustrated in FIG. 18B.

To erect the carrier, the leading and trailing edges of the collapsed carrier move inwardly towards each other as described above in the fifth embodiment to automatically construct individual cells and the articles enter their respective cells C1, C2, C3 to complete the loading process, ready to be supplied to the user. The handle structure H and base structure are also formed in like manner to provide a fully erected carton similar to that illustrated in FIG. 19. The advantages of the shape of the upper edges of the blank and base of the present embodiment have already been referred to in respect of the fifth embodiment above and are not therefore described in any greater detail. A further advantage of the present invention is that the blanks forming the partition structure can be reduced in width because, it is not necessary for the transverse partition panels 682, 684 to extend the width W of the cell as the outer transverse panels provide the rigidity.

Figures 20A, 20B:
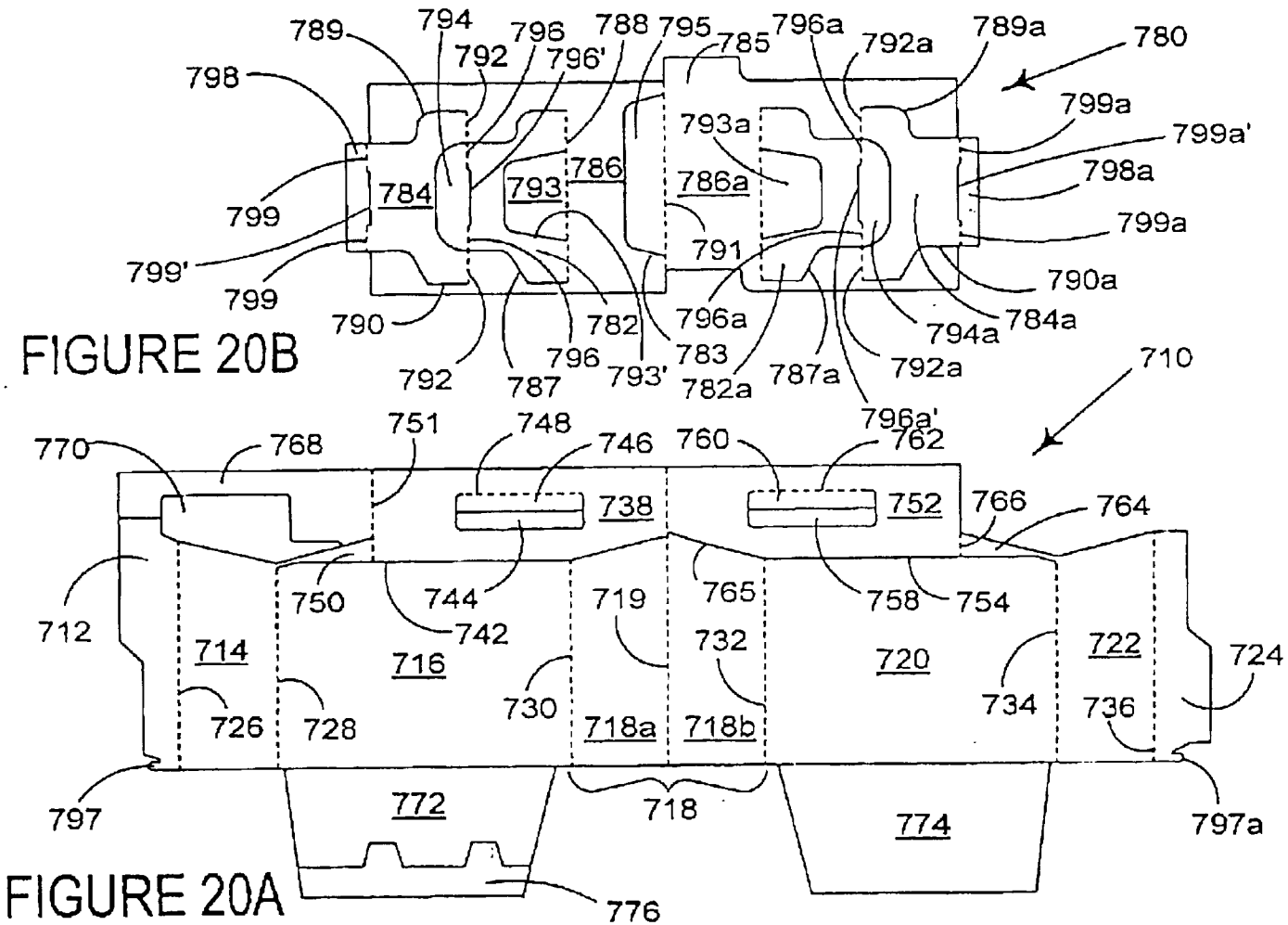
FIGS. 20A and 20B are plan views of blanks of paperboard from which a basket carrier according to an eighth embodiment of the invention is formed.

Referring now to FIGS. 20A and 20B, there is shown an eighth embodiment of the invention. An article carrier is formed from one or more blanks 710 of paperboard or other suitable foldable sheet material. The carrier is adapted to accommodate a plurality of articles, for example six bottles arranged in two rows of three bottles each. It is envisaged the carrier can be adapted to accommodate a different number of articles according to user requirements.

In this embodiment, the carrier is formed from a two part blank and the blank 710, forming the outer panels, includes in longitudinal series a first medial support panel 712, first end panel 714, first side panel 716, second end panel 718, second side panel 720, third end panel 722 and second medial panel 724 hingedly connected one to the next along lateral fold lines 726, 728, 730, 732, 734 and 736 respectively. There may further comprise a lateral fold line 719 intermediate fold lines 730 and 732 for dividing second end panel 718 into two parts (718*a*, 718*b*) to form an "arrow profile" basket carrier, hereinafter described.

A first handle panel 738 is disposed adjacent second end panel 718 and first side panel 716 and is separated from these side and end panels by cut line 742. Cut line 742 extends between fold lines 728 and 719. Handle panel 738 is hingedly connected to second end panel 718 along an extension of fold line 719 which forms part of one side edge of first handle panel 738. Handle panel 738 is connected to the first end panel 714 by means of an intermediate panel 750 which is hingedly connected to the side edge of handle panel 738 along fold line 751, and to first end panel 714 along fold line 728.

Handle panel 738 may include a hand aperture 744. In this embodiment, a hand cushioning flap 746 is connected along fold line 748 to an upper edge of hand aperture 744.

A second handle panel 752 is disposed adjacent second side panel 720 and second end panel 718 and is separated from these side and end panels by cut lines 754, 765. Cut lines 754, 756 extend between fold lines 719 and 734. Handle panel 752 is hingedly connected to handle panel 738 along fold line 719. Handle panel 752 is connected to the third end panel 722 by means of an intermediate panel 764 which is hingedly connected to the side edge of handle panel 752 along fold line 766, and to end panel 722 along fold line 734.

Handle panel 752 may include a hand aperture 758. In this embodiment, a hand cushioning flap 760 is connected along fold line 762 to an upper edge of hand aperture 760.

In this embodiment, a triple ply handle structure is provided. Handle support panel 768 is disposed adjacent part of intermediate panel 750 and the medial support panel 712. Handle support panel 768 is hingedly connected to a side edge of first handle panel 738 along fold line 751, but is otherwise separated from the blank. In alternative embodiments, handle support panel may alternatively be connected to second handle panel 752. A hand recess 770 is provided and is preferably positioned to be aligned with the hand apertures 744 and 758 in a set up carton.

Hooks 797, 797*a* may be provided along lower edges of first and second medial panels 712 and 724 to provide a detachable connection to the base structure.

There further comprises a base structure which in this embodiment is provided by base panels 772, 774 foldably connected to side panels 716, 720 respectively. Suitable securing means is provided for securing the base panels together. For example, a glue flap 776 is connected to the base panel 772. Alternatively, locking tabs struck from base panel and a complementary pair of locking apertures are struck from second base panel to receive and retain the locking tabs, as is well known. It will be understood by those skilled in the art that other methods of interlocking the base panels together during construction can be adopted and the invention is not limited to those features illustrated in the embodiments or described above.

As shown in FIGS. 20B, both sides of a partition structure of the article carrier are preferably formed from a second blank 780. The blank 780 comprises a pair of transverse partition panels 782, 784 struck from a medial partition panel 786. Transverse partition panel 782 is struck from medial panel 786 by cut line 787 and is connected thereto along fold line 788. Likewise, transverse partition panel 784 is struck from medial panel 786 by cut lines 789, 790 and is connected thereto along fold line 792. In this embodiment fold line 792 is interrupted by cut line 787 which extends into transverse partition panel 784 to define a glue flap 794 foldably connected to transverse partition panel 782 along fold line 796. A second glue flap 798 may be connected to transverse partition panel 784 along fold line 799 Fold lines 799 and 796 are preferably interrupted by cut lines 799 and 796 respectively. A tab 795 is preferably struck from medial partition panel 786 is defined by cut line 783 and fold line 791. A further tab 793 is preferably struck from transverse panel 782 and is defined by a cut line 793 and fold line 788.

A second medial partition panel 786*a* substantially mirrors the first 786, along fold line 791 and therefore like panels are designated by the same reference numeral with addition of letter "a". Therefore, only the differences between blank 780 and blank 780*a* are described in more detail.

A projecting portion 785 of panel 786*a* is provided so as to cooperate with handle support panel 768 and thereby ensure that the handle is triple ply throughout. A corresponding cutaway portion is included in the opposite edge of the blank to minimise paperboard wastage if multiple blanks are struck in a tessellating pattern.

It is envisaged that the number and position of the transverse partition panels of each blank can be changed according to the number and size of article receiving cells required.

Figure 21A:
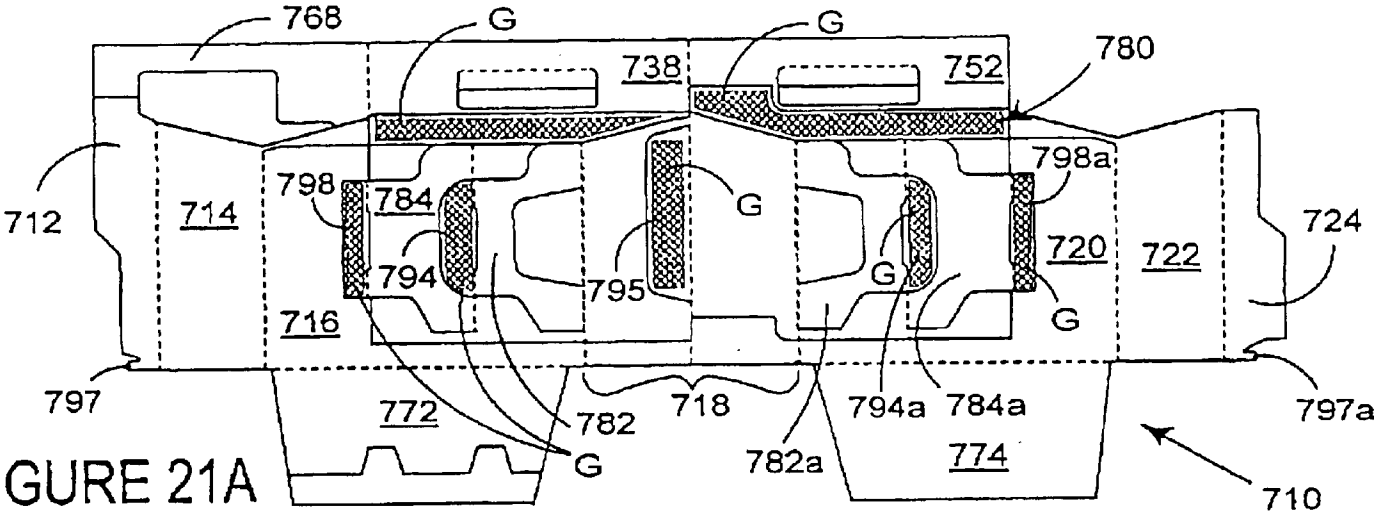
FIGS. 21A and 21B are side elevation views of the blanks shown in FIGS. 20A and 20B during construction to form a flat collapsed carton.
Figure 21B:
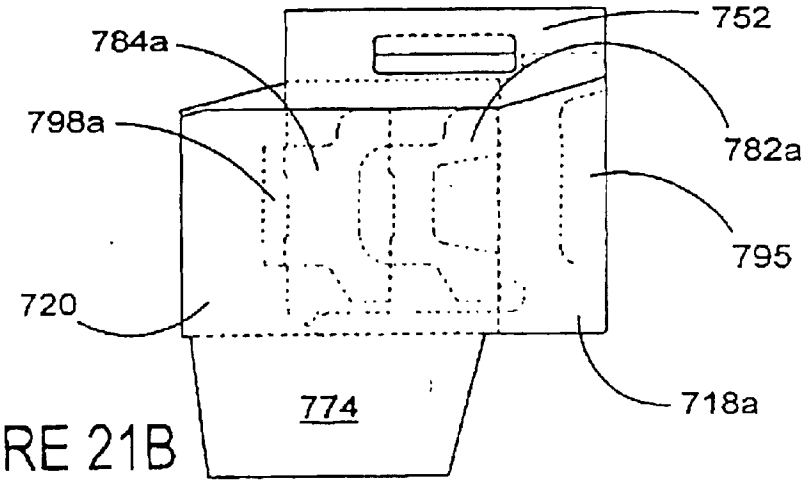

The construction of a completed carrier of the eighth embodiment shown in FIGS. 21A and 21B in a flat collapsed condition from the blank requires a series of sequential folding and gluing operations which can be performed in a straight line gluing machine so that the carton is not required to be rotated or inverted to complete its construction. The gluing positions of the blanks are highlighted by hatching although it is envisaged that the blanks can be glued at other positions, if desired. The folding process is not limited to that described below and can be altered according to particular manufacturing requirements. Thus, blank 780 is secured to blank 710.

In this embodiment, the flaps 794, 798 are secured to side panel 716 and medial panel 786 is secured to handle panel 738 by glue or other suitable means. Likewise, glue flaps 794*a* and 798*a* are secured to side panel 720 and medial partition panel 786*a* is secured to handle panel 752 by glue or other suitable means. Thus the carton is at a first stage of construction, shown in FIG. 21A.

Thereafter, handle support panel 768 is folded about fold line 751 and into face contacting relationship with handle panel 738 so that recess 770 and aperture 758 are aligned. First and third end panels 714 and 722 are folded inwardly along fold lines 728 and 734 respectively, such that medial support panels 712 and 724 may be secured to medial panels 786 and 768*a* respectively using glue or other suitable means known in the art. Second end panel 718 is folded in half along fold line 719 such that intermediate panels 750, 764 are in face contacting relationship with first end panel 714. In some embodiments, intermediate panels 750, 764 are secured to first end panel 714 by glue or other suitable means in the art.

Handle panels 738, 752 may be secured together by glue or other suitable means in the art. The outer panels 718*b*, 720, 722 forming one side of the partition are folded into face contacting relationship with the outer panels 718*a*, 716, 714 forming the other side of the partition.

By folding the panels in this way, the two sides of the basket carrier are brought into a face to face relationship with each other and the handle panels 752, 768 are secured together with the inner face of handle panel 738 by glue or other means known in the art. Preferably, tab 793*a* is secured to tab 793.

The carton is then at an intermediate stage, shown in FIG. 21B: a completed collapsed article carrier whereby third end panel 722, second side panel 720 and outer handle panel 752 are placed in a face to face relationship with first end panel 714, first side panel 716 and handle panel 738 respectively. The carton of the first embodiment is commonly referred to as an "arrow profile" pack, because the end panels are folded about a central fold line to define two trailing edges 736, 726 and a leading edge defined by fold lines 719.

Figure 22:
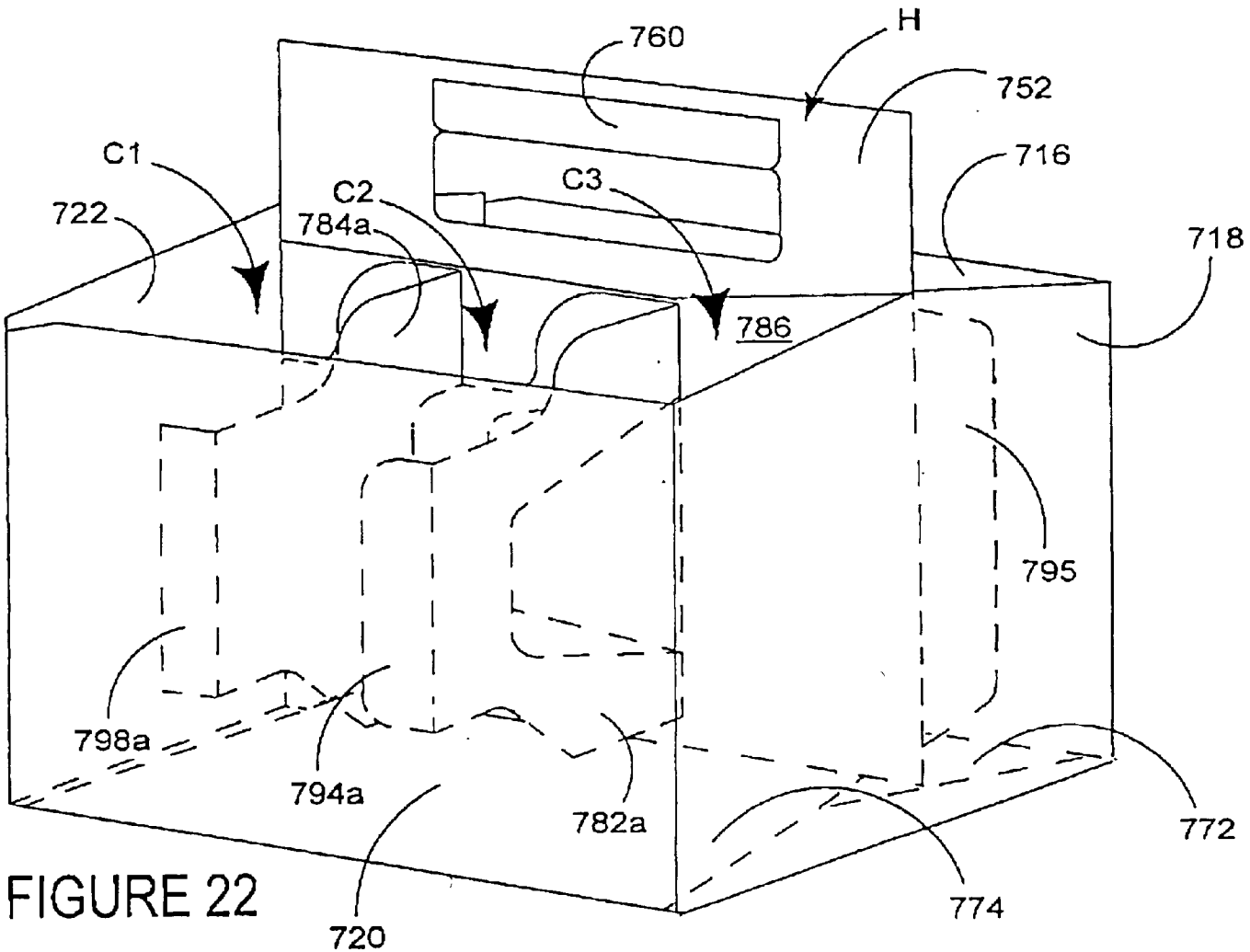
FIG. 22 is a perspective view of an erected basket carrier formed from the blank shown in FIGS. 20A and 20B viewed from above and from one end.

To erect the article carrier, the leading and trailing edges of the collapsed carrier are moved inwardly towards each other. This causes end panels 714, 722 and 718, and side panels 716 and 720 moved from a flat collapsed condition into a rectangular configuration which facilitates the construction of individual cells. As illustrated in FIG. 22, three cells C1, C2, C3 are thus formed. Similarly, transverse partition panels 782*a*, 784*a* are moved out of alignment with second side panel 720 and handle panel 752 and are folded about fold lines 788*a*, 792*a* respectively so that transverse partition panels 794*a*, 798*a* are in a perpendicular relationship with respect to handle panel 752 and side wall panel 720. Thus, transverse partition panels 794, 798 are moved out of alignment with first side panel 716 and handle panel 738 and are folded about fold lines 788 and 792 respectively such that transverse partition panels 782, 784 are in a substantially perpendicular relationship with respect to handle panel 738 and side panel 716 such that three further cells are formed. In use, the transverse partition panels may separate and support the articles in adjacent cells.

The carton is then ready to receive articles which are preferably loaded by relative vertical movement between the articles and carrier during forward feed movement as is well known in the art, by which the articles enter their respective cells through the open bottom of the carrier. Alternatively, the bottles can enter their respective cells through the top of the carrier.

Thereafter, the base is formed whereby base panels 722 and 724 are brought into an overlapping relationship and connected together by securing means well known in the art. In this embodiment glue flap 776 is glued to base panel 774. The base panels may be held in place prior to loading and/or after loading by engagement of the base panels 772, 774 with the hooks 797, 797*a* shown in FIGS. 20A and 21A.

In use, handle tabs 746, 760 are folded about handle panels 738, 752 to further secure hand structure H and the carton. Thus the carton of the first embodiment is in a set up condition as shown in FIG. 22 of the drawings.

Figure 23C:
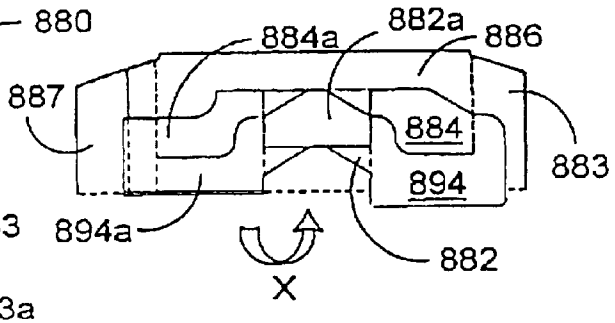
FIG. 23C is a plan view of the blank of FIGURE 23B, showing the bank having been folded about a bottom fold line in a direction indicated by arrow X;"
Figure 23B:
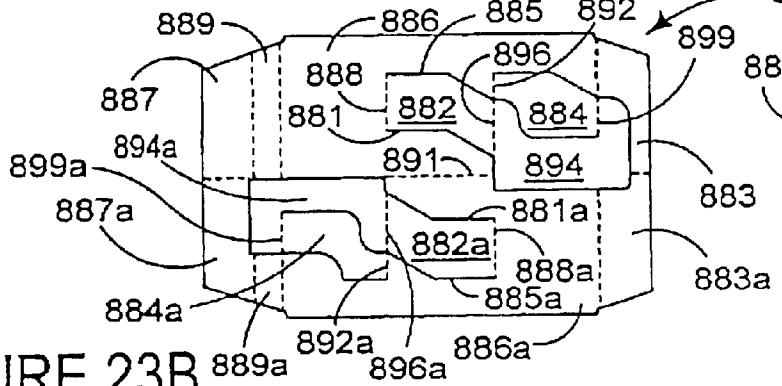
FIGS. 23A and 23B are plan views of blanks of paperboard from which a basket carrier according to the ninth embodiment of the invention is formed.
Figure 23A:
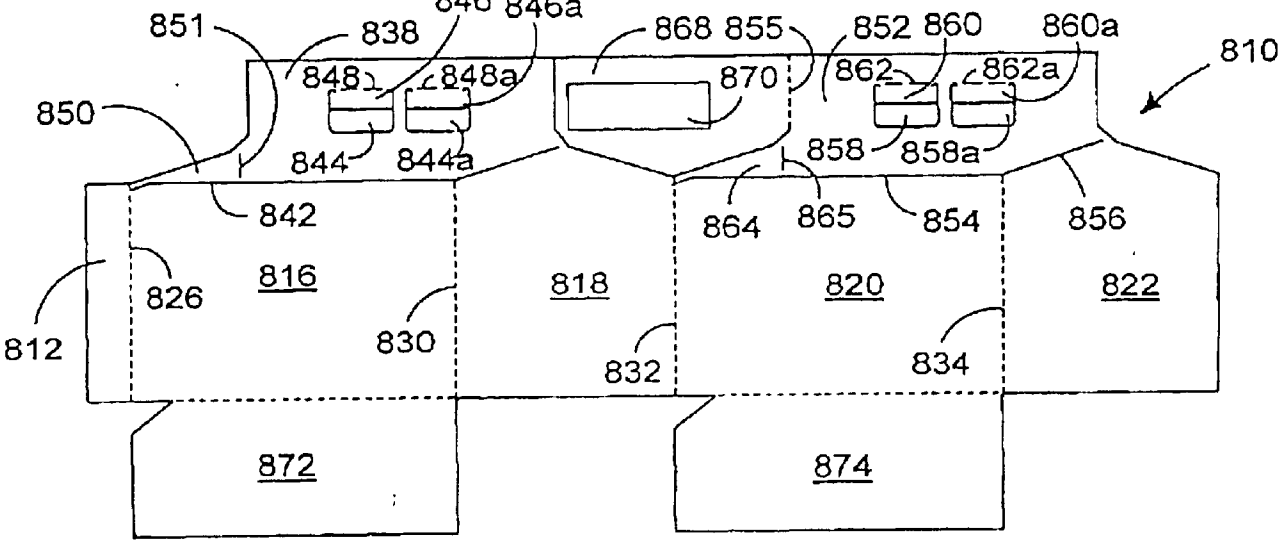

Turning to the construction of the ninth embodiment shown in FIGS. 23A and 23B there is shown an article carrier formed from a two part blank. The blanks are capable of forming a "parallelogram profile" pack, described below. Blank 810, shown in FIG. 23A, provides the outer panels of the carrier and includes in longitudinal series, a glue flap 812, first side panel 816, first end panel 818, second side panel 820 and second end panel 822 foldably connected one to the next along lateral fold lines 826, 830, 832, 834 respectively.

A first handle panel 838 is disposed adjacent first end panel 818 and first side panel 816 and is separated from the side and end panels by cut line 842 extending from fold line 826 and into end panel 818. Handle panel 838 is hingedly connected to an upper edge of end panel 818. The point of connection should be in a central part, if it is desired for the handle to be centrally located. Handle panel 838 is foldably connected along its opposing edge to glue flap 812 by an intermediate panel 850. In this embodiment, intermediate panel 850 is hingedly connected to a side edge of handle panel 838 along fold line 851, and to glue flap along fold line 826 as shown in FIG. 23A. Handle panel 838 may include a pair of hand/finger apertures 844, 844*a*. In this embodiment, a pair of hand cushioning flaps 846, 846*a* are connected along fold lines 848, 848*a* to upper edges of respective hand apertures 844, 844*a*.

A second handle panel 852 is disposed adjacent a second side panel 820 and second end panel 822 and is separated from the side and end panels by cut lines 854 and 856 respectively which extend from fold lines 832 and into end panel 822. Handle panel 852 is hingedly connected to an upper edge end panel 822 and to the opposing end panel 818 by an intermediate panel 864. In this embodiment, intermediate panel 864 is foldably connected to a side edge of handle panel 852 along fold line 865 and to end panel 818 along fold line 832. Second handle panel 852 preferably includes a pair of hand/finger apertures 858, 858*a*. In this embodiment, hand cushioning flaps 860, 860*a* are connected along fold lines 862 and 862*a* to an upper edge of respective hand apertures 858, 858*a*.

In this embodiment, a triple ply handle structure is provided which includes a handle support panel 868, hingedly connected to a side edge of handle panel 852 along fold line 855. Support panel 868 further includes a hand aperture 870, positioned intermediate upper and lower edges of handle support panel 868. Hand aperture 870 is positioned to be aligned with hand apertures 854, 858 in a set up carton. In alternative classes of embodiment, two apertures may be provided in handle support panel 868 that are arranged to be in register with the apertures on the handle panels in a set up carton.

A base structure is formed from panels 872, 874 which in this embodiment is substantially the same as the eighth embodiment and is not, therefore described in any greater detail.

The partition structure of the article carrier is formed from a second blank 880. The blank 880 comprises a pair of transverse partition panels 882, 884 struck from a medial partition panel 886. Transverse partition panel 882 is struck from medial panel 886 by cut lines 885 and 881 and is foldably connected thereto along fold line 888. Transverse partition panel 882 is further hingedly connected to glue flap 894 along fold line 896. As in the first embodiment, it is envisaged the number and position of the transverse panels can be altered according to the number of article receiving cells required.

Likewise, transverse partition panel 884 is struck from medial panel 886 by extensions of cut lines 885 and 881 and is foldably connected thereto along fold line 892. Transverse panel 884 is further hingedly connected to glue flap 894 along fold line 899. Medial partition panel is further hingedly connected at opposing edges thereof to glue flaps 883, 887 and 889.

A second medial panel 886*a* is hingedly connected to panel 886 along fold line 891. The second medial panel 886*a* is similar to panel 786, and therefore like panels are designated by the same reference numeral with the addition of the letter "a". The only difference between the panels is that glue panel 894*a* does not in this embodiment extend into panel 886, in contrast to panel 894 which does extend into panel 886*a*.

Figure 24A:
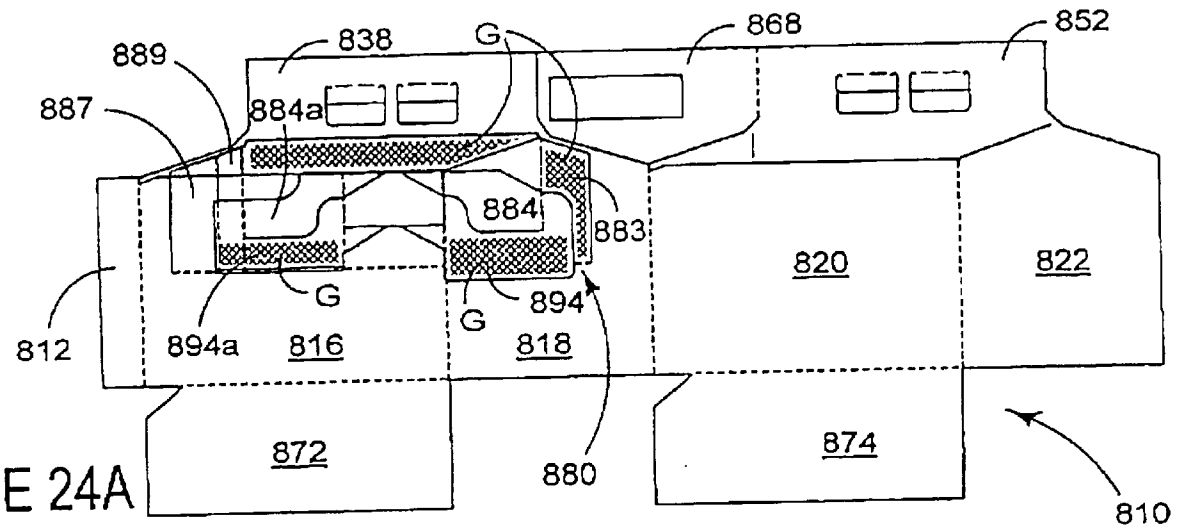
FIGS. 24A and 24B are side elevation views of the blanks shown in FIGS. 23A and 23B during construction to form a flat collapsed carton.
Figure 24B:
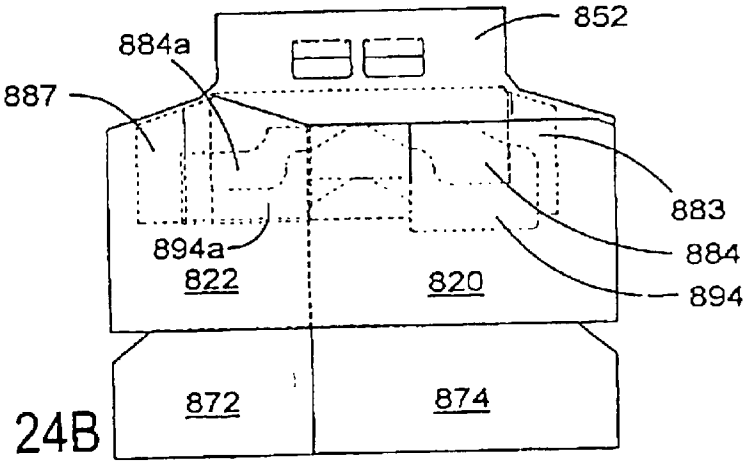

The construction of the completed carrier of the ninth embodiment shown, in FIGS. 23C, 24A and 24B, in a flat collapsed condition from the blank requires a series of sequential folding and gluing operations which can be performed in a straight line gluing machine, so that the carton is not required to be rotated or inverted to complete its construction. The gluing positions of the blanks are highlighted by hatching, although it is envisaged that other blanks can be glued at other positions if desired. The folding process is not limited to that described below and can be altered according to particular manufacturing requirements.

Thus, referring to FIG. 23C, blank 880 is folded about fold line 891 in a direction indicated by arrow X such that panel 886*a* substantially overlies panel 886. The folded blank 880 is secured to blank 810. In this embodiment, glue flap 894*a* is secured to side panel 816, medial panel 886*a* is secured to handle panel 838 and glue flap 883*a* is secured to first end panel 818. Thus, the carton is at a first stage of construction shown in FIG. 24A. Thereafter handle support panel 868 is folded so as to overlie handle panel 852 and glue flap 812 is folded about fold line 826 into face contacting relationship with side panel 816 and the outer panels 820 and 822 are folded about fold line 832 into face contacting relationship with medial panel 886. End panel 822 is secured to glue flap 812 and transverse glue flap 894 is secured to side wall 820. Handle panel 852 is preferably secured to the opposing face of handle support panel 868 and glue flaps 887 and 889 are secured to end panel 822.

By folding and securing the panels in this way the two sides of the basket carrier are brought into face to face relationship such that the article carrier is in a completed and collapsed condition, shown in FIG. 24B. The carton of the ninth embodiment is, commonly, referred to as a "parallelogram profile" pack because the leading edge is defined by fold line 432 and the trailing edge is defined by diametrically opposed edge provided by fold line 426.

To erect the article carrier, the leading and trailing edges of the collapsed carrier are moved inwardly towards each other, this causes end panels 822 and 818 and side panels 816 and 820 to be moved from a flat collapsed condition into a rectangular configuration which facilitates construction of the individual cells. Thus, transverse partition panels 882, 884, 882*a*, 884*a* are moved out of alignment with first and second side panels 820, 816 respectively and are folded about fold lines 888, 892, 888*a* and 892*a*, such that the transverse partition panels are in a substantially perpendicular relationship with respect to handle panel 868 and side panels 816 and 820. It will be seen from FIG. 25 that each part 882, 884; 882*a*, 884*a* extends from each side of the medial panel to form two rows of three cells C1, C2, C3. In use, the transverse partition panels may separate and support the articles in adjacent cells.

Figure 25:
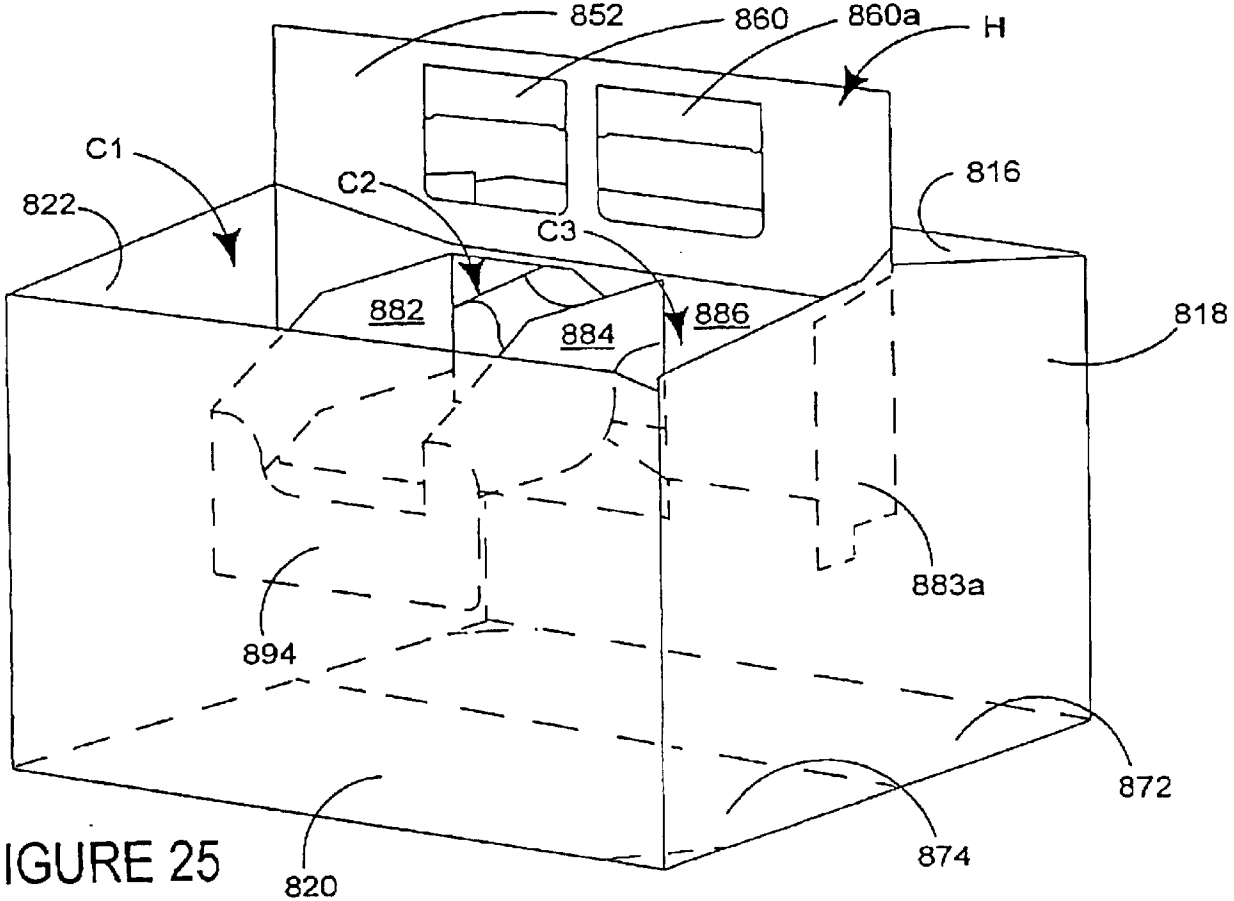
FIG. 25 is a perspective view of an erected basket carrier formed from the blank shown in FIGS. 23A and 23B viewed from above and from one end.

The carton is then ready to receive articles which are preferably loaded a relative vertical movement between the articles and the carrier during forward feed movement well known in the art by which the articles enter their respective cells through the open bottom of the carrier. Alternatively, the bottles can enter their respective cells through the top of the carrier. Thereafter the base is formed in substantially the same manner as described above whereby base panels 472, 474 are connected together by securing means. Similarly handle tabs 446, 460 are folded about handle 468, 452 to further secure hand structure H and the carton. Thus the carton of the ninth embodiment is in a set up condition as shown in FIG. 25 of the drawings.

A common feature shared by both the eighth and ninth embodiments relates to the handle panel structure H. More particularly, the handle panels and, as the case may be, the handle support panels are co-planar. The upper edges of the handle panels are co-linear as shown in FIGS. 20A and 23A, so as to minimise the paperboard wasted because adjacent blanks can be struck from a continuous roll with their respective upper edges in abutment.

A further common feature is the use of a single medial blank which is folded along one edge to form the medial and transverse panels along both sides of the handle panel. In certain circumstances this may simply mechanisation of the erection process.

It will be recognised that as used herein, directional references such as "top", "base", "end", and "side" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

The present invention and its preferred embodiments relate to an article carrier which is shaped to provide satisfactory strength to hold the bottle securely but with a degree of flexibility so that load transferred to the handle is absorbed by the carrier. The shape of the blank minimises the amount of paperboard required. The carrier can be applied to an array of bottles by hand or automatic machinery. It is anticipated that the particular features of each of the embodiments described above are interchangeable, without departing from the scope of the invention.

What is claimed is:

1. A blank for forming an article carrier of the basket type comprising a first end panel, a first side panel, a second end panel, a second side panel and a third end panel hingedly connected one to the next in series, a base panel hinged to one of said side or end panels and a handle structure including a hand aperture, each of the first and second side panels has a pair of opposed side edges and an upper edge extending between the opposed side edges, the handle structure comprises first and second handle panels hingedly connected to said second end panel, at least one of said first and second handle panels being connected to said second end panel by an intermediate panel, the first handle panel is hingedly connected to the first end panel and the second handle pane is connected to the third end panel, the first and second handle panels are so constructed and arranged to be placed in face contacting relationship to form a two ply handle when the carrier is in a set up condition, wherein the first and second handle panels are disposed adjacent respectively to the first and second side panels along the upper edges and are separated respectively from the first and second side panels by first and second cut lines extending entirely along the upper edges respectively.

2. A blank according to claim 1 wherein there further comprises a handle support panel foldably connected to the first handle panel for forming a triple ply handle in a set up condition.

3. A blank according to claim 2 wherein the first and second handle panels are co-planar and upper edges of said handle panels are co-linear.

4. A blank according to claim 2 wherein there further comprises a second handle support panel foldably connected to the first handle panel.

5. A blank according to claim 4 wherein the first and second handle panels are co-planar and upper edges of said handle panels are co-linear.

6. A blank according to claim 3 wherein the upper edges of the handle panels are co-linear with an upper edge of said handle support panel.

7. A blank according to claim 1 wherein said handle panels are substantially trapezoidal in shape.

8. A blank according to claim 1 wherein a medial support panel is hingedly to each of opposing ends of the series of panels, the medial support panels being so arranged as to be secured together when the carrier is in a set up condition.

9. A blank according to claim 1 wherein a medial support panel is hingedly connected to each of opposing ends of the series of panels, and at least one of said medial support panels is provided with a hook portion, the hook portion being so arranged as to engage the base panel, when the blank is erected to form a carton.

10. A blank according to claim 1 wherein said handle panels are shaped to marry with first and second handle panels of a next adjacent blank.

11. A blank according to claim 1 wherein there further comprises a medial support panel arranged so as to support at least one medial panel when the blank is erected to form a carton.

12. A blank for forming an article carrier of the basket type comprising a first end panel, a first side panel, a second end panel, a second side panel and a third end panel hingedly connected one to the next in series, a base panel hinged to one of said side or end panels and a handle structure including a hand aperture, which handle structure comprises first and second handle panels hingedly connected to said second end panel, at least one of said first and second handle panels being connected to said second end panel by an intermediate panel, the first handle panel is hingedly connected to the first end panel and the second handle panel is hingedly connected to the third end panel, the first and second handle panels are so constructed and arranged to be placed in face contacting relationship to form a two ply handle when the carrier is in a set up condition, wherein the first and second handle panels are adjacent respectively to the first and second side panels and are separated respectively from the first and second side panels by first and second cut lines, wherein upper edges of the handle panels are co-linear, wherein the handle panels are substantially trapezoidal in shape, and wherein a medial support panel is hingedly connected to each of opposing ends of the series of panels, the medial support panels being so arranged as to be secured together when the carrier is in a set up condition.

13. A blank for forming an article carrier of the basket type comprising a first end panel, a first side panel, a second end panel, a second side panel and a third end panel hingedly connected one to the next in series, a base panel hinged to one of said side or end panels and a handle structure including a hand aperture, which handle structure comprises first and second handle panels hingedly connected to said second end panel at least one of said first and second handle panels being connected to said second end panel by an intermediate panel, the first handle panel is hingedly connected to the first end panel and the second handle panel is hingedly connected to the third end panel, the first and second handle panels are so constructed and arranged to be placed in face contacting relationship to form a two ply handle when the carrier is in a set up condition, wherein the first and second handle panels are adjacent respectively to the first and second side panels and are separated respectively from the first and second side panels by first and second cut lines, wherein upper edges of the handle panels are co-linear, wherein the handle panels are substantially trapezoidal in shape, wherein a medial support panel is hingedly connected to each of opposing ends of the series of panels, and wherein at least one of the medial support panels is provided with a hook portion, the hook portion being so arranged as to engage the base panel when the blank is erected to form a carton.

* * * * *